US007522180B2

(12) United States Patent
Toyoda

(10) Patent No.: US 7,522,180 B2
(45) Date of Patent: Apr. 21, 2009

(54) IMAGE WRITING APPARATUS AND COLOR IMAGE FORMING APPARATUS

(75) Inventor: Koji Toyoda, Saitama-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/798,347

(22) Filed: May 14, 2007

(65) Prior Publication Data

US 2007/0216755 A1 Sep. 20, 2007

Related U.S. Application Data

(62) Division of application No. 10/378,623, filed on Mar. 5, 2003, now Pat. No. 7,227,563.

(30) Foreign Application Priority Data

Mar. 11, 2002 (JP) ..... 2002-065255

(51) Int. Cl.
*B41J 15/14* (2006.01)
*B41J 27/00* (2006.01)

(52) U.S. Cl. ..... 347/244; 347/258

(58) Field of Classification Search ..... 347/243–244, 347/256–261, 230, 241, 242
See application file for complete search history.

(56) References Cited

U.S. PATENT DOCUMENTS 6,256,133 B1 7/2001 Suzuki et al. ..... 359/207
6,304,282 B1 10/2001 Fujimoto ..... 347/242
6,489,982 B2 12/2002 Ishibe ..... 347/134
6,831,764 B2 * 12/2004 Shimomura et al. ..... 347/244
7,227,563 B2 * 6/2007 Toyoda ..... 347/244

FOREIGN PATENT DOCUMENTS

| | | |
|---|---|---|
| JP | 6-18796 | 1/1994 |
| JP | 8-50385 | 2/1996 |
| JP | 8-146325 | 6/1996 |
| JP | 8-300721 | 11/1996 |
| JP | 11-125784 | 5/1999 |
| JP | 11-242370 | 9/1999 |
| JP | 2000-187173 | 7/2000 |
| JP | 2000-258713 | 9/2000 |
| JP | 2001-242404 | 9/2001 |

OTHER PUBLICATIONS

Japanese Office Action dated Sep. 2, 2008, from corresponding Japanese Application No. 2002-065255.

* cited by examiner

*Primary Examiner*—Hai C Pham
(74) *Attorney, Agent, or Firm*—Fitzpatrick, Cella, Harper & Scinto

(57) ABSTRACT

The present invention provides a color image forming apparatus forming an image by using a plurality of image carriers, wherein at least one lens having identical optical characteristics and forming individual scanning optical systems which scan the individual image carriers with beams is formed by use of a plurality of cavities. When dividing the cavities into a plurality of groups in response to variations in the optical characteristics caused by cavity difference of the lenses formed with the plurality of cavities so that the relative differences in an optical parameters are within an allowable range, at least one lens of each scanning optical system is selected from the cavities of one of the plurality of groups.

2 Claims, 21 Drawing Sheets d:COLOR DRIFT IN SUB-SCANNING DIRECTION

IMAGE WRITING APPARATUS AND COLOR IMAGE FORMING APPARATUS

This application is a division of application Ser. No. 10/378,623, filed Mar. 5, 2003, now U.S. Pat. No. 7,227,563, issued Jun. 5, 2007, the contents of which is Incorporated herein by reference.

BACKGROUND OF THE INVENTION

1. Field of the Invention

The present invention relates to an image writing apparatus. More particularly, the invention relates to an image writing apparatus suitable for use as a color forming apparatus such as a color laser beam printer, a color digital copying machine, or a multi-function printer.

2. Description of the Related Art

In scanning optical apparatuses such as laser beam printers, color digital copying machines or multi-function printers, it is the conventional practice to record an image by periodically causing deflection of a beam, which is optically modulated or emitted in response to an image signal from a light source, by using an optical deflector comprising, for example, a rotating polygon mirror, and conveying the deflected beam into a spot on the surface of a photosensitive recording medium (photosensitive drum) by a scanning lens system (scanning optical system) having an fθ characteristic, to optically scan the surface of said recording medium.

FIG. 15 is a partial schematic view of a conventional optical scanning apparatus. In FIG. 15, a diverging beam emitted from a light source 91 comprising a semiconductor laser and the like is converted by a collimator lens 92 into a substantially parallel beam (or a converging beam). The beam (light intensity) is shaped by an aperture stop 93, and is incident on a cylindrical lens 94 having a refractive strength only in the sub-scanning direction. The beam incident on the cylindrical lens 94 is emitted unrefracted in the main scanning cross-section, and in the sub-scanning cross-section, it converges and is formed substantially into a line image near a deflecting surface 95*a* of the light deflector 95 comprising a rotating polygon mirror.

Subsequently, the beam reflected and deflected at the deflecting surface 95*a* of the light deflector 95 is introduced onto the surface of the photosensitive drum 98, serving as the scanned surface via a reflecting mirror 97 through a scanning lens system (scanning optical system) 96 having an fθ characteristic, and the deflector 95 is rotated in the direction indicated by arrow A, thereby optically scanning the photosensitive drum 98 surface in the direction indicated by arrow B (main scanning direction) at a constant speed to record image information.

Various color image forming apparatuses, such as color laser beam printers, color digital copying machines, and multi-function printers, each having a plurality of image carriers corresponding to the primary colors of output images (yellow: Y, magenta: M, cyan: C, and black: Bk) have conventionally been used. In these conventional color image forming apparatuses, each image carrier has a configuration including a plurality of optical scanning apparatuses like the above-mentioned conventional case are arranged, or a plurality of optical scanning apparatuses capable of scanning a plurality of image carriers simultaneously.

For example, in Japanese Patent Laid-Open No. 8-50385, four photosensitive drums are arranged, these drums serving as four image carriers corresponding to the colors yellow, magenta, cyan, and black, and one optical scanning apparatus is provided for each photosensitive drum. A desired image is formed by overlapping images of the individual colors on a conveyor belt.

In Japanese Patent Laid-Open No. 6-18796, a desired color image is formed by arranging two optical scanning apparatuses capable of scanning two photosensitive drums from among the four photosensitive drums serving as four image carriers corresponding to the four colors.

When forming a color image by using a plurality of optical scanning apparatuses, the positions of spots (dots) forming an image on the image carriers by the operation of the individual optical scanning apparatuses should be relatively aligned in each scanning region, both in the main scanning direction and in the sub-scanning direction. This means that it is necessary that the spot intervals in the main scanning direction and the scanning line inclination or curvature and the line intervals in the sub-scanning direction be in agreement. If this relative alignment of the spot positions is not achieved, upon overlapping on the conveyor belt, a color shift causes a decrease in quality of the output image. It is therefore important that the scanning accuracy of the individual optical scanning apparatuses be uniform and the positional relationship between the optical scanning apparatus and the corresponding image carrier be in agreement in each case.

For example, in Japanese Patent Laid-Open No. 8-50385, a color image is formed by using four optical scanning apparatuses and four image carriers corresponding thereto. In this case, it is desirable that dots formed on the image carrier by the optical scanning apparatus be perfectly in alignment with the corresponding dots formed by the three other optical scanning apparatuses when they overlap on the conveyor belt.

In an actual optical scanning apparatus, however, shifts between these dot positions are caused by accuracy errors of the individual optical parts, accuracy errors of the individual mechanical components for assembling the optical parts, such as an optical box, assembly errors of the optical parts, and relative positional errors between the optical scanning apparatus and the image carrier. When all of the optical scanning apparatuses have identical errors, no shift in the dot position is produced. Usually, however, the plurality of optical scanning apparatuses have different errors, and this is a factor causing color shift. The resultant color image therefore exhibits color shift in the main scanning direction as well as in the sub-scanning direction.

Color shifts in the sub-scanning direction caused by optical factors can be broadly classified into a scanning line inclination component and a curvature factor. In the optical scanning apparatus shown in FIG. 15, for example, when the optical scanning apparatus has a single-unit accuracy error caused by a slight rotation of the optical surface of the scanning lens system 96, or when a lens is wrongly mounted in the optical casing tilting in the axial direction in parallel with the optical axis occurs due to this assembly error, and the dot positions in the sub-scanning direction having an inclination component, as shown in FIG. 16. This phenomenon will now be described for two color shift components from among the four colors for simplicity of explanation.

On the assumption that one component is for cyan (C) and the other is for magenta (M) in FIG. 16, scanning line inclination is produced for both of these colors. The amount of inclination differs between the two colors in FIG. 16, because there are variations in the error components, such as a single-unit accuracy error and an assembly error. If both cyan and magenta have identical error components, i.e., if the two colors, having errors as compared with an ideal state, have the same amounts of inclination when there is no dispersion, it is possible to obtain an image free from color shift.

Actually, however, there are variations in all error factors, and this causes color shifting. To reduce this color shifting, in the conventional optical scanning apparatus, an adjusting mechanism is provided, for example, to tilt the entire optical scanning apparatus to make an adjustment so as to achieve perfect positional alignment of the scanning lines.

When an inclination of the scanning lines shown in FIG. 16 occurs, the inclination components of two colors finally agree with each other as shown in FIG. 17, by adjusting the inclination for the cyan and magenta optical scanning apparatuses around an axis in parallel with the optical axes of these optical scanning apparatus, thus correcting the color shifting.

When the lens has a single-unit accuracy error, or when the lens is mounted so as to be tilted or shifted in the axial direction in parallel with the main scanning direction due to an assembly error in the optical casing, the dot position in the sub-scanning direction would have a curvature component of the scanning lines, as shown in FIG. 18.

As in FIG. 16, FIG. 18 assumes that one curvature is for cyan (C), and the other is for magenta (M), and curvature of the scanning line curvature is produced for both. In FIG. 18, the amount of curvature differs between the two colors because there are variations in the error components, such as single-unit accuracy error and assembly error. When cyan and magenta have identical error components, i.e., when they deviate from the ideal state, but there is no dispersion in this state, and the same amounts of curvature result, a color image free from color shift is obtained.

Actually, however, all the error factors contain variations, causing color shift. In order to reduce the color shift, an adjusting mechanism is provided in conventional optical scanning apparatuses. For example, in Japanese Patent Laid-Open No. 2000-258713, the scanning line curvature is adjusted for by bending the reflecting mirror of the optical scanning apparatus.

When a scanning line curvature as shown in FIG. 18 occurs, adjustment is made by bending the mirrors provided in the optical scanning apparatus for cyan and magenta. In this adjustment method, however, it is necessary to bend the mirror itself by applying a large stress because of the low sensitivity of the mirror to scanning line curvature, and assembly accuracy, environmental changes, and the adjustment accuracy itself are problematic.

One of the most important factors causing scanning line curvature is the single-unit accuracy error of the lens. At present, the scanning lenses used in scanning optical apparatuses are formed in a plastic mold or a glass mold in response to the demands for cost reduction. Supply of low-cost lenses is therefore permitted by manufacturing a die having a plurality of cavities with identical specifications, or preparing a plurality of dies with identical specifications.

In FIG. 19, for example, four lenses with identical optical characteristics can be manufactured in a forming step by providing four cavities A, B, C and D in a single mold Z. In FIG. 20, it is possible to manufacture four lenses during the forming period of a production run by providing four molds V, W, X and Y having cavities E, F, G and H with identical specifications.

However, in the mold Z of FIG. 19, for example, frames and parts forming the cavities A, B, C and D having identical optical characteristics contain manufacturing errors including assembly errors with the mold. Because there occur delicate differences in the forming conditions between cavities, these factors cause accuracy errors in the four lenses formed. This is also the case with the configuration shown in FIG. 20.

The face apex height in the sub-scanning direction of the thus formed four lenses A, B, C and D may have single-unit accuracy errors, such as a curvature, along the main scanning direction, as shown in FIG. 21, and the single-unit accuracy error may often differ for the four lenses A, B, C and D. The occurrence of such single-unit accuracy errors causes refraction of a beam passing through the lens in the sub-scanning direction, and would cause scanning line curvature on the scanned surface. This scanning line curvature is caused by the four lenses A, B, C and D, and the scanning line curvature differs between the four lenses depending on the single-unit accuracy error. When four such lenses A, B, C and D are arranged in a single color image forming apparatus, this is a factor causing color shift in the sub-scanning direction.

The single-unit accuracy error of a lens is similarly a factor causing a partial magnification error in the main scanning direction. For example, when a geometric surface error from the design shape of the second face (emitting face) of the lens is as shown by a thick line in FIG. 22, and upon drawing dots at equal intervals on the scanned surface, there is an interval error as compared with an ideal interval, i.e., a partial magnification error. The partial magnification error differs between the four lenses A, B, C and D. Arrangement of four such lenses A, B, C and D in a single color image forming apparatus is a factor causing color shift in the main scanning direction.

SUMMARY OF THE INVENTION

It is an object of the present invention to provide a color image forming apparatus which, over the entire scanning region on the surface of an image carrier, reduces dot positional shift in the sub-scanning direction or/and the main scanning direction, and enables to obtain a satisfactory color image containing only a small shift component in the sub-scanning direction or/and main scanning direction to be obtained.

A first aspect of the present invention relates to an image writing apparatus for forming an image on a plurality of image carriers by scanning the image carriers with a plurality of beams, comprising lenses having identical optical characteristics, and forming individual scanning optical systems which scan the individual image carriers with beams, at least one of which is formed by use of a plurality of cavities, wherein, when dividing cavities into a plurality of groups according to variations in the optical characteristics caused by cavity difference of the lenses formed by the plurality of cavities so that relative differences in an optical parameter are within an allowable range, at least one lens of each scanning optical system is selected from cavities of one of the plurality of groups.

A second aspect of the present invention relates to the image writing apparatus according to the first aspect of the invention, wherein the optical parameter is the height of an irradiating position on the surfaces of the image carriers.

A third aspect of the present invention relates to the image writing apparatus according to the first aspect of the invention, wherein the allowable range of optical parameters is such that the relative difference in the irradiating position height is within 100 μm over the entire scanning region on the surfaces of the image carriers.

A fourth aspect of the present invention relates to the image writing apparatus according to the first aspect of the invention, wherein the optical parameter is the partial magnification in a main scanning direction on the surfaces of the image carriers.

A fifth aspect of the present invention relates to the image writing apparatus according to the first aspect of the invention, wherein the allowable range of said optical parameter is such that the relative difference in dot positional shift in the main scanning direction is within 100 μm over the entire scanning region on the surfaces of the image carriers.

A sixth aspect of the present invention relates to an image writing apparatus for forming an image on a plurality of image carriers by scanning the image carriers with a plurality of beams, comprising lenses having identical optical characteristics, and forming individual scanning optical systems which scan the individual image carriers with beams, at least one of which is formed by use of a plurality of cavities, wherein, when dividing cavities into a plurality of groups according to variations in optical characteristics caused by cavity difference of the lenses formed by the plurality of cavities so that a relative differences in optical parameter are within an allowable range, lenses used for an image writing apparatus is selected from cavities of one of the groups, and each of the plurality of groups has at least one cavity belonging to all the plurality of groups.

A seventh aspect of the present invention relates to the image writing apparatus according to the sixth aspect of the invention, wherein the optical parameter is the height of an irradiating position on the surface of the image carriers.

An eighth aspect of the present invention relates to the image writing apparatus according to the sixth aspect of the invention, wherein the allowable range of optical parameters is such that the relative difference in the irradiating position height is within 100 μm over the entire scanning region on the surfaces of the image carriers.

A ninth aspect of the present invention relates to the image writing apparatus according to the sixth aspect of the invention, wherein the optical parameter is a partial magnification in a main scanning direction on the surfaces of the image carriers.

A tenth aspect of the present invention relates to the image writing apparatus according to the sixth aspect of the invention, wherein the allowable range of the optical parameter is such that the relative difference in dot positional shift in a main scanning direction is within 100 μm over the entire scanning region on the surfaces of the image carriers.

An eleventh aspect of the present invention relates to an image writing apparatus for forming an image on a plurality of image carriers by scanning the image carriers with a plurality of beams, comprising lenses having identical optical characteristics, and forming individual scanning optical systems which scan the individual image carriers with beams, at least one of which is formed by use of a plurality of cavities, and that at least one lens used in the image writing apparatus is formed with cavities whose number lies within a range from two to n−1, when the number of the plurality of cavities is n ($n \geqq 3$).

A twelfth aspect of the present invention relates to the image writing apparatus according to the eleventh aspect of the invention, wherein an optical parameter is the height of an irradiating position on the surfaces of the image carriers.

A thirteenth aspect of the present invention relates to the image writing apparatus according to the eleventh aspect of the invention, wherein the allowable range of optical parameters is such that the relative difference in the irradiating position height is within 100 μm over the entire scanning region on the surfaces of the image carriers.

A fourteenth aspect of the present invention relates to the image writing apparatus according to the eleventh aspect of the invention, wherein the optical parameter is a partial magnification in a main scanning direction on the surfaces of the image carriers.

A fifteenth aspect of the present invention relates to the image writing apparatus according to the eleventh aspect of the invention, wherein the allowable range of optical parameter is such that the relative difference in dot positional shift in a main scanning direction is within 100 μm over the entire scanning region on the surfaces of the image carriers.

A sixteenth aspect of the present invention relates to an image writing apparatus according to any one of the first to fifteenth aspects of the invention, having a printer controller which converts a color signal entered from an external device into an image data of a different color, and enters the image data into the image writing apparatus.

Further objects, features and advantages of the present invention will become apparent from the following description of the preferred embodiments (with reference to the attached drawings).

DESCRIPTION OF THE PREFERRED EMBODIMENTS

First Embodiment

Figure 1:
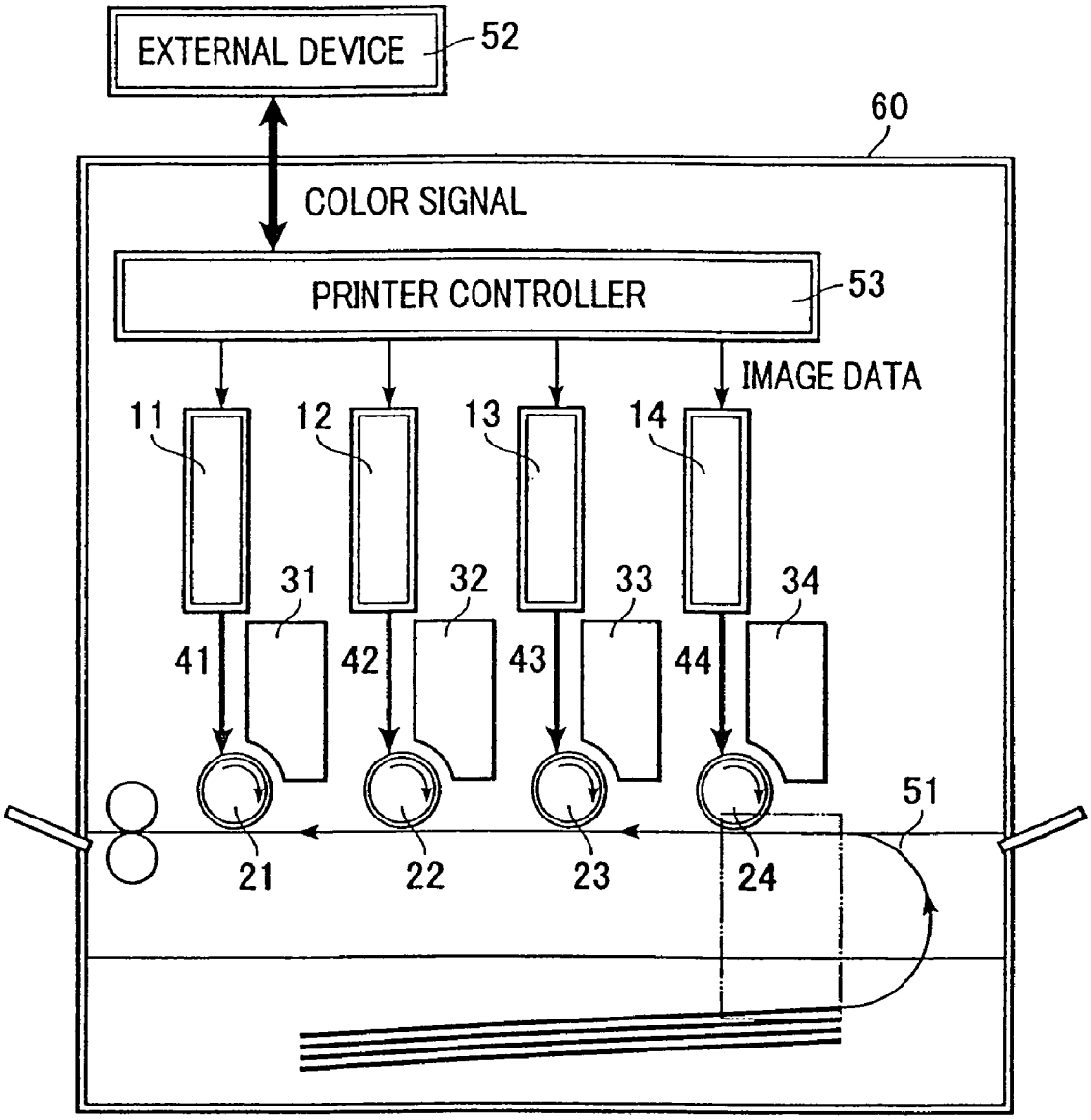
FIG. 1 is a partial schematic view of the color image forming apparatus of a first embodiment of the present invention.

FIG. 1 is a partial schematic view of a color image forming apparatus of a first embodiment of the present invention. This embodiment covers a tandem-type color image forming apparatus in which four scanning optical apparatuses are arranged, and image information is recorded in parallel on the surfaces of photosensitive drums serving as image carriers.

An image writing apparatus of the present invention is defined as having a plurality of optical scanning apparatuses.

In the present invention, a plurality of optical scanning apparatuses may be separately arranged in the image writing apparatus, or they may be integrally arranged.

In this embodiment, the image writing apparatus holds/contains four optical scanning apparatuses arranged in parallel with each other.

The direction in which the beam is reflected and deflected (deflection scanning) by deflecting means is defined as the main scanning direction, and the direction perpendicular to the optical axis of the optical scanning system (scanning lens system) and the main scanning direction is defined as the sub-scanning direction.

In FIG. 1, reference numeral 60 represents a color image forming apparatus; 11, 12, 13, and 14 represent optical scanning apparatuses having a configuration described later; 21, 22, 23, and 24 represent photosensitive drums serving as image carriers; 31, 32, 33, and 34 represent developing units; and 51 represents a conveyor belt.

In FIG. 1, R (red), G (green) and B (blue) color signals are input from an external device 52, such as a personal computer, into the color image forming apparatus 60. These color signals are converted by a printer controller 53 in the apparatus into C (cyan), M (magenta), Y (yellow), and B (black) image data (dot data). These image data are entered into the scanning optical apparatuses 11, 12, 13, and 14, respectively. Light beams 41, 42, 43, and 44, which are modulated in response to the image data are emitted from these scanning optical apparatuses 41, 42, 43, and 44, and the photosensitive surfaces of the photosensitive drums 21, 22, 23, and 24 are scanned by these light beams 41, 42, 43, and 44.

In the color image forming apparatus 60 of this embodiment, the four optical scanning apparatuses 11, 12, 13, and 14 are arranged to correspond to the colors C (cyan), M (magenta), Y (yellow) and B (black), and record image signals (image information) on the surfaces of the photosensitive drums 21, 22, 23, and 24 in parallel with each other to achieve high speed printing of color images.

The color image forming apparatus 60 of this embodiment forms latent images of the individual colors onto the corresponding surfaces of the photosensitive drums 21, 22, 23 and 24 by using light beams based on the individual image data by means of the four optical scanning apparatuses 11, 12, 13, and 14, as described above. Thereafter, a single full-color image is formed by multiple-transfer onto a recording medium.

The above-mentioned external device 52 may be a color image reader having, for example, a CCD sensor. In this case, this color image reader and the color image forming apparatus 60 form a color digital copying machine.

In this embodiment, at least one lens forming each scanning lens system (optical scanning system) which scans the surfaces of the individual photosensitive drums 21, 22, 23, and 24 with light beams is formed by using a plurality of cavities. When dividing cavities into a plurality of groups so that the relative difference in an optical parameter is within an allowable range according to variations in the optical characteristics (amount of scanning line curvature) caused by cavity differences of the lenses formed by the plurality of cavities, at least one lens of each scanning lens system is selected from cavities of one of the plurality of groups. The above-mentioned optical parameter is the height of the irradiating position on the photosensitive drum surface, and the allowable range of this optical parameter is within 100 μm as represented by a relative difference in the irradiating position over the entire scanning region on the surfaces of the photosensitive drums.

Figure 2:
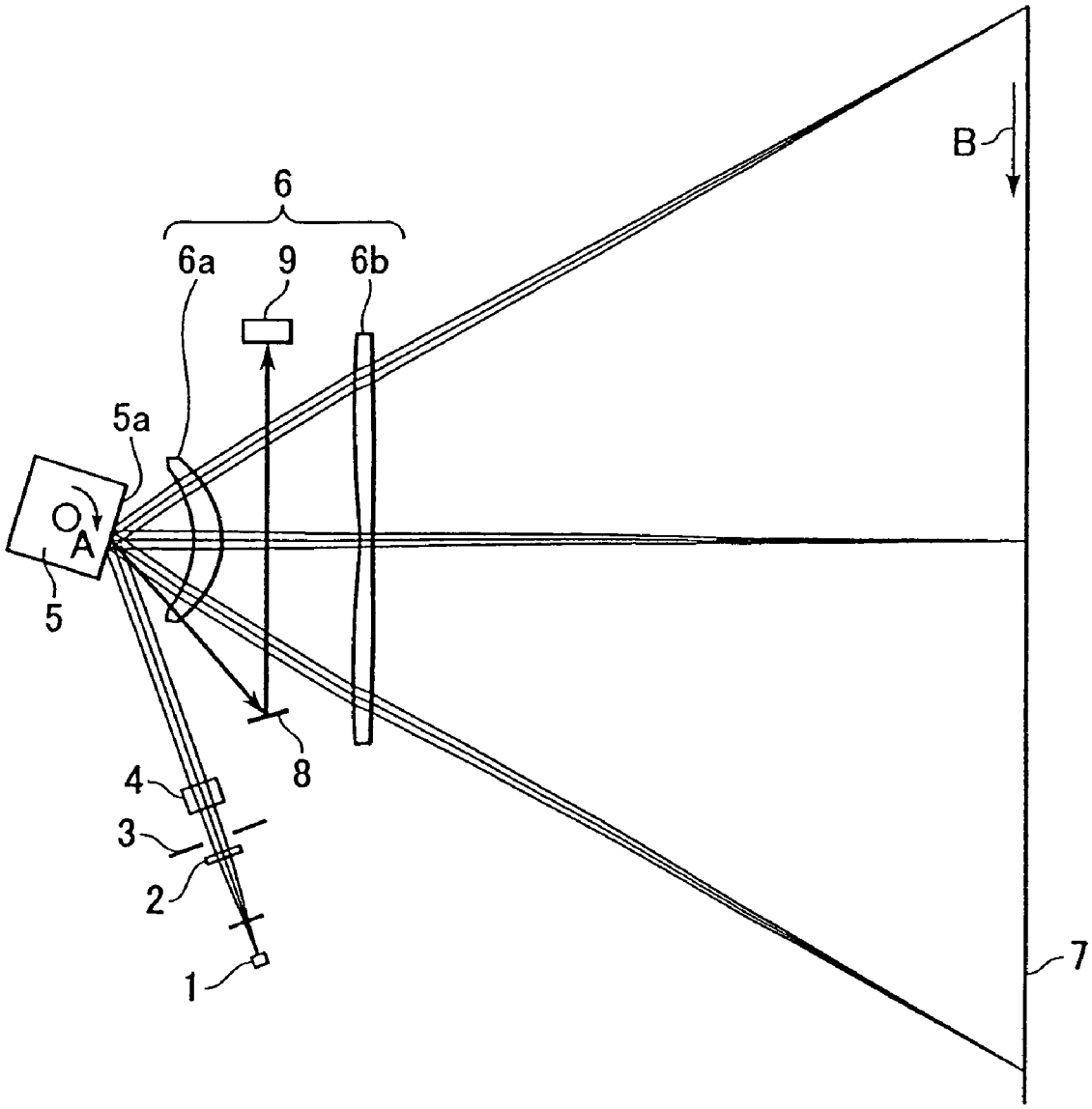
FIG. 2 is a partial sectional view in the main scanning direction of an optical scanning apparatus shown in FIG. 1 (main scanning sectional view).

FIG. 2 is a partial sectional view in the main scanning direction (main scanning sectional view) illustrating one optical scanning apparatus and the corresponding photosensitive drum.

In FIG. 2, reference numeral 1 represents light source comprising, for example, a semiconductor laser. Reference numeral 2 represents a collimator lens which converts the diverging beam emitted from the light source 1 into a substantially collimated beam (or converging beam). Reference numeral 3 represents an aperture stop which adjusts the beam shape by restricting the beams passing therethrough. Reference numeral 4 represents a cylindrical lens which has a prescribed power only in the sub-scanning direction and which forms the beam passing through the aperture stop 3 in the sub-scanning cross-section into substantially a line image on the deflection surface (reflection surface) 5*a* of the light deflector 5 (described later). The factors such as the collimator lens 2, the aperture stop 3 and the cylindrical lens 4 form respectively factors of the incident optical means.

Reference numeral 5 represents a light deflector serving as a deflecting means. It comprises, for example, a polygon mirror composed of four faces (rotating polygon mirror), and it is rotated at a constant speed in the direction indicated by arrow A by driving means (not shown), such as a motor.

Reference numeral 6 represents a scanning lens system (optical scanning system) serving as optical scanning means having a condensing function and fθ characteristics, and comprising first and second scanning lenses 6*a* and 6*b*. The scanning lens system 6 forms the light beam based on image information reflected and deflected by the light deflector 5 into an image on the surface of the photosensitive drum 7 and has a falling correcting function to maintain a conjugate relationship between the deflecting surface 5*a* of the light deflector 5 and the surface of the photosensitive drum 7 within a sub-scanning cross-section.

Reference numeral 7 represents photosensitive drum serving as an image carrier (corresponding, for example, to reference numeral 21 in FIG. 1); 8 represents a BD mirror for synchronous detection; and 9 represents a BD sensor for synchronous detection.

In FIG. 2, the diverging beam emitted from the semiconductor laser 1 and modulated in response to the image data from the printer controller is converted by the collimator lens 2 into a substantially parallel beam. This beam (light intensity) is restricted by the aperture stop 3, and the beam is incident on the cylindrical lens 4. After being incident on the substantially parallel beam, the cylindrical lens is output unrefracted on the main scanning direction. In the sub-scanning direction, the beam converges, and is formed into substantially a line image (line image extending in the main scanning direction) on the deflection surface 5*a* of the light deflector 5. The beams reflected and deflected at the deflection surface 5*a* of the light deflector 5 is formed into a spot-shaped image on the surface of the photosensitive drum 7 via the first and second scanning lenses 6*a* and 6*b*. The surface of the photosensitive drum 7 is optically scanned at a constant speed in the direction indicated by arrow B (in the main scanning direction) by rotating the light deflector 5 in the direction indicated by arrow A. An image is thus recorded on the surface of the photosensitive drum 7 serving as a recording medium.

Figure 3:
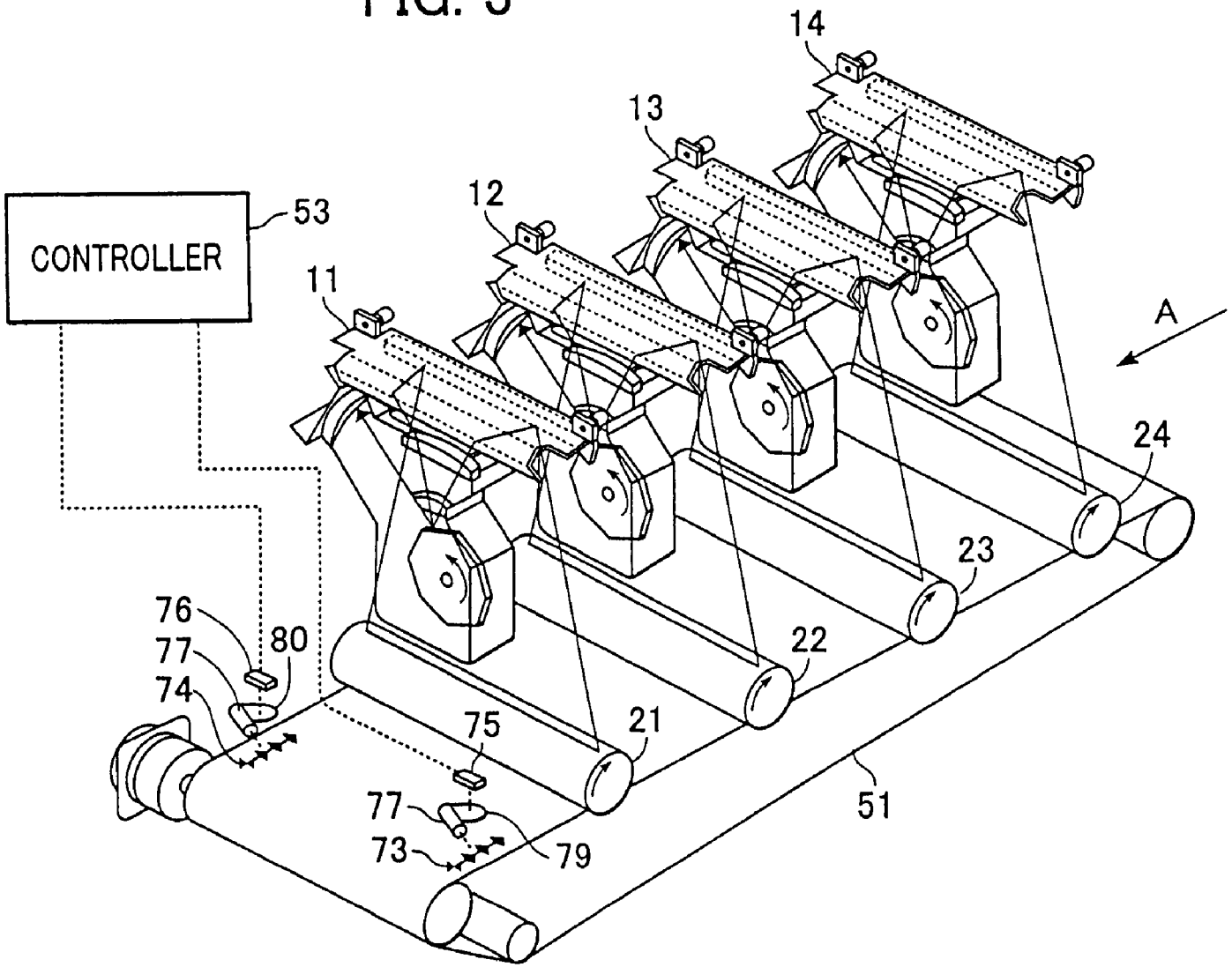
FIG. 3 is a partial perspective view of the color image forming apparatus of the first embodiment of the invention.

FIG. 3 is a partial perspective view of a color image forming apparatus of this embodiment.

In this embodiment, after forming images by the individual optical scanning apparatuses 11, 12, 13, and 14 on the surfaces of the photosensitive drums 21, 22, 23, and 24, resist marks 73 and 74 transferred onto the conveyor belt 51 are detected by resist detecting means (a resist mark position is detected by receiving in resist mark detectors 75 and 76 reflected light of the light emitted from the light source 77 onto the conveyor belt 51 via condenser lenses 79 and 80 to determine the amount of sub-scanning-direction positional error at the image height where the resist detecting means is arranged. Thereafter, the color shift in the sub-scanning direction is reduced by carrying out polygon phase control of the individual optical scanning apparatuses 11, 12, 13, and 14, in response to the thus determined positional error.

Figure 19:
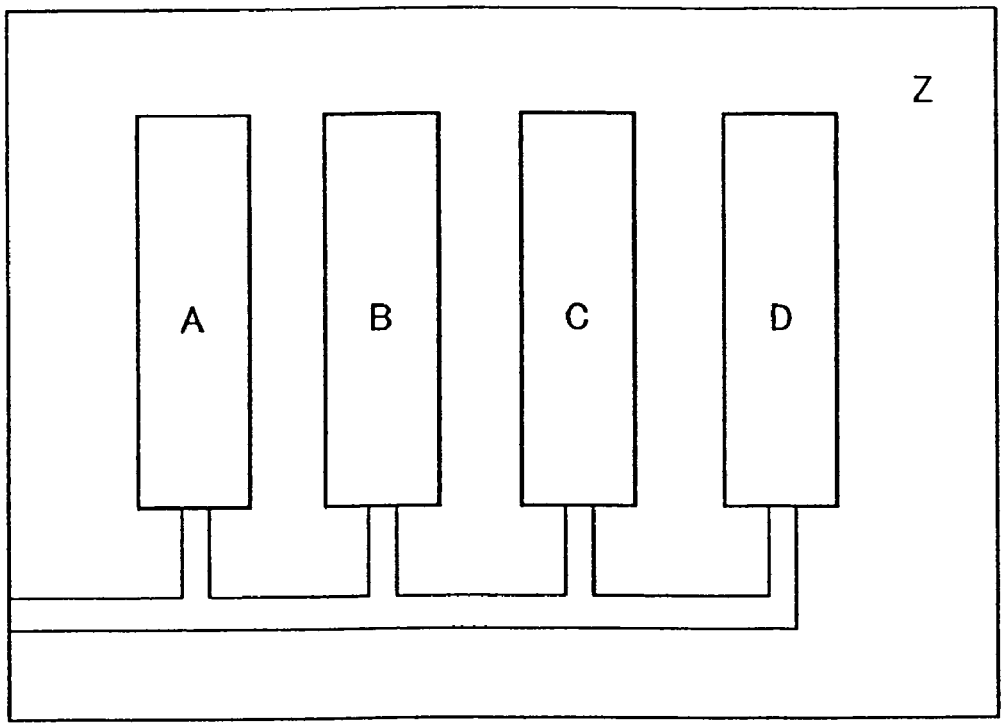
FIG. 19 illustrates a mold having a plurality of cavities.

In this embodiment, from among the first and second scanning lenses 6*a* and 6*b* forming the scanning lens system 6 arranged in the individual optical scanning apparatuses 11, 12, 13, and 14, the second scanning lens 6*b* is formed with the plurality of cavities A, B, C, and D shown in FIG. 19. For the cavity lens 6*b* having a large error relative to the maximum or the average resulting from the variation in the amount of a scanning line curvature caused by cavity difference of the second scanning lens formed with a plurality of cavities A, B, C, and D (hereinafter referred to as the "cavity lens"), all the four optical scanning apparatuses formed within a single color image forming apparatus are uniform in terms of cavities.

More specifically, when the cavities are divided into a plurality of groups so that the relative difference in an optical parameter is within an allowable range in response to the variation in the optical characteristics (amount of scanning line curvature) caused by the cavity differences of the lenses formed by the plurality of cavities A, B, C, and D, as described above, at least one lens of each scanning lens system is selected from cavities of one of the plurality of groups.

Figure 4:
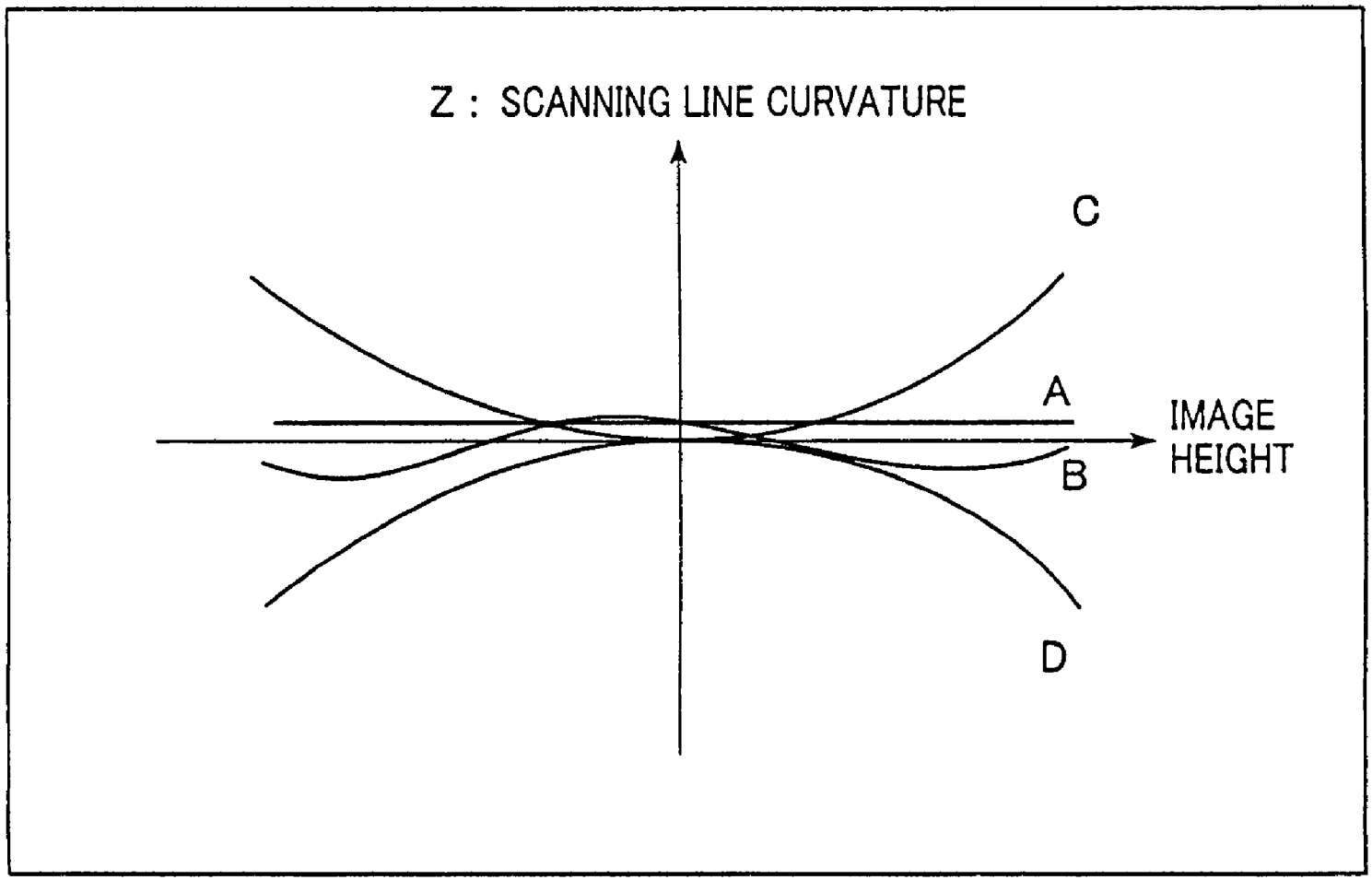
FIG. 4 illustrates variation in scanning line curvature in the first embodiment of the invention.

FIG. 4 is a descriptive view illustrating the variation in the amount of scanning line curvature of the second scanning lens 6*b* caused by the cavity differences. The second scanning lens 6*b* is formed with the four cavities A, B, C, and D. While the A and B cavity lenses result in an average or only a small error relative to the average of the four cavities h the variation in the amount of the scanning line curvature, the C and D cavity lenses lead to a maximum variation in the amount of curvature. If, among the four optical scanning apparatuses, at least each one has a C or D cavity lens mounted therein, then the maximum amount of color shift is caused in the sub-scanning direction by the second scanning lens 6*b*. Therefore, this configuration is not desirable.

In this embodiment, when the C and D cavity lenses are used for all four optical scanning apparatuses provided in a single color image forming apparatus, reduction of the amount of color shift caused by scanning line curvature is achieved by all four apparatuses uniformly having the C or D cavity lenses. In this case, a color image forming apparatus may be configured with A and B lenses, A and B cavity lenses leaving cavity differences.

As is clear from the above description, in this embodiment, when the variation in the amount of scanning line curvature caused by the cavity differences of the scanning lens formed with a plurality of cavities A, B, C, and D is such that the cavity lenses have large errors relative to the maximum or the average, color shift in the sub-scanning direction can be reduced by causing all of the optical scanning apparatuses provided in a single color image forming apparatus to be of identical cavities (cavities C or D), thereby achieving a color image forming apparatus which can give a satisfactory color image output.

In this embodiment, a lens is stamped to specify from what group the cavity was selected. This is also the case with the second to ninth embodiments.

A stamp is provided so as to permit the cavity used to form the scanning lens (mold lens) to be determined. For example, a scanning lens formed with the cavity A has a type stamped in the form of "No . . . A"; a scanning lens formed with the cavity B has a type stamped in the form of "No . . . B"; a scanning lens formed with the cavity C has a type stamped in the form of "No . . . C"; and a scanning lens formed with the cavity D has a type stamped in the form of "No . . . D".

When verifying the present invention, if scanning lenses in the four optical scanning apparatuses comprise a scanning lens A formed (type No.: "No . . . A") and a scanning lens B (type No.: "No . . . B"), the color image forming apparatus can be concluded as using the present invention.

This verification is applicable also for the second to ninth embodiments.

In this embodiment, the scanning lens system 6 comprises two lenses. The present invention is not however limited to this, but the scanning lens system 6 may comprise a single lens or three or more lenses.

This embodiment has been described for the case of mold formed of four cavities. In the present invention, however, molds formed with three or more cavities may be used. For example, in the present invention, molds formed with six, eight, ten or twelve cavities may be used. Of course, in the present invention, molds formed with three or more cavities may be used in the following second to ninth embodiments.

Second Embodiment

A second embodiment of the present invention will now be described. Differences from the above-mentioned first embodiment will mainly be described.

In this embodiment, when dividing the cavities into a plurality of groups so that a relative difference in optical parameters is within an allowable range, according to variations in the optical parameters (amount of scanning line curvature) caused by the cavity difference of lenses formed with a plurality of cavities, a lens used in a color image forming apparatus is selected from cavities of one of these groups. Any of these plurality of groups has at least one cavity belonging to all the plurality of groups.

Figure 20:
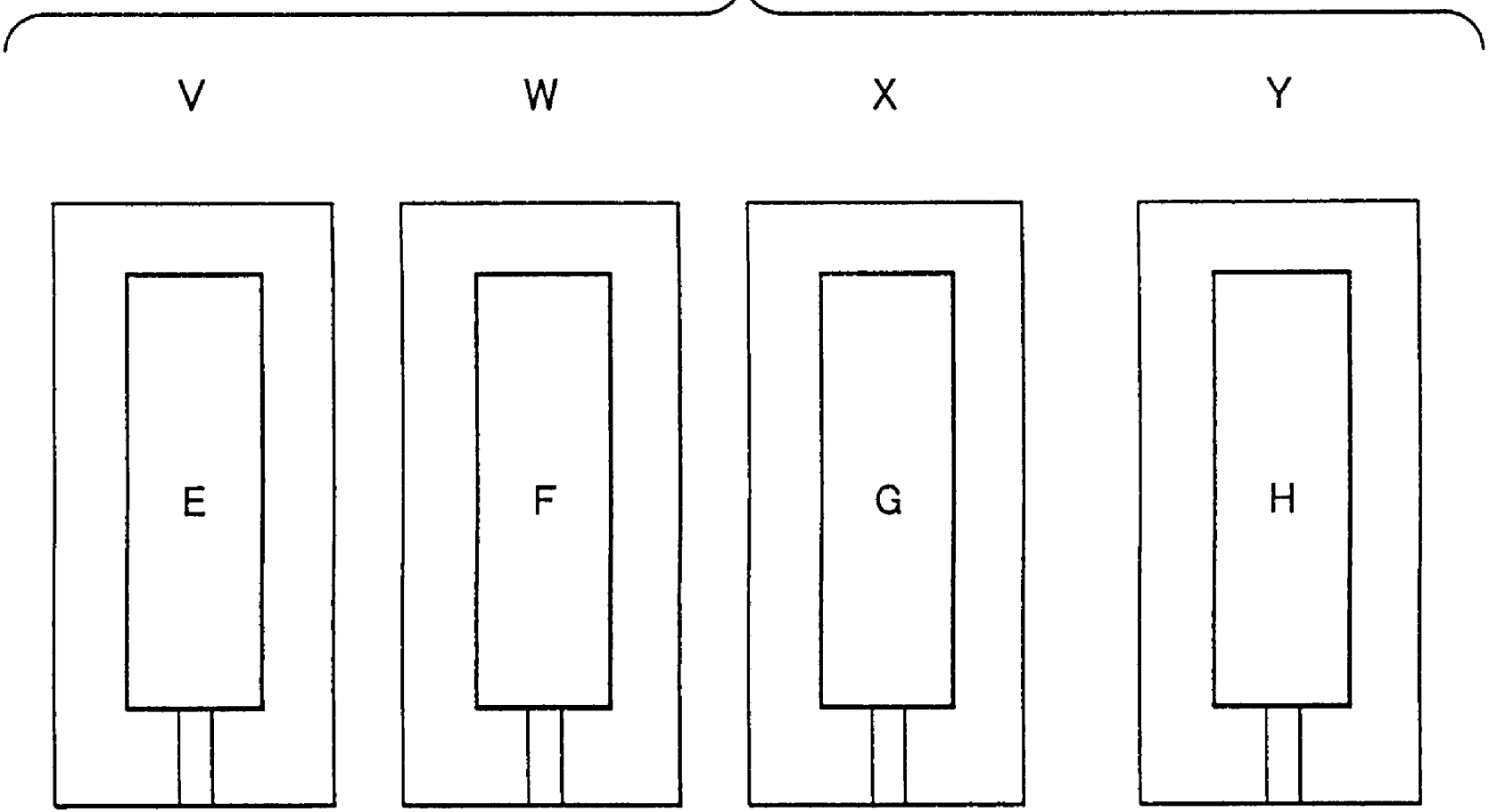
FIG. 20 illustrates a plurality of molds.

In this embodiment, more specifically, the second scanning lens 6*b*, for example, from among the first and second scanning lenses 6*a* and 6*b* forming the scanning lens system 6 arranged in each of the scanning optical apparatuses is formed by using a plurality of cavities E, F, G, and H shown in FIG. 20. For the cavity lens 6*b* for which the variation in the amount of scanning line curvature caused by a cavity difference of the second scanning lens 6*b* formed with the plurality of cavities E, F, G and H is such that the error is on an average level or smaller than the average, it is made possible to combine the same with any of all the other cavities in a single color image forming apparatus.

Figure 5:
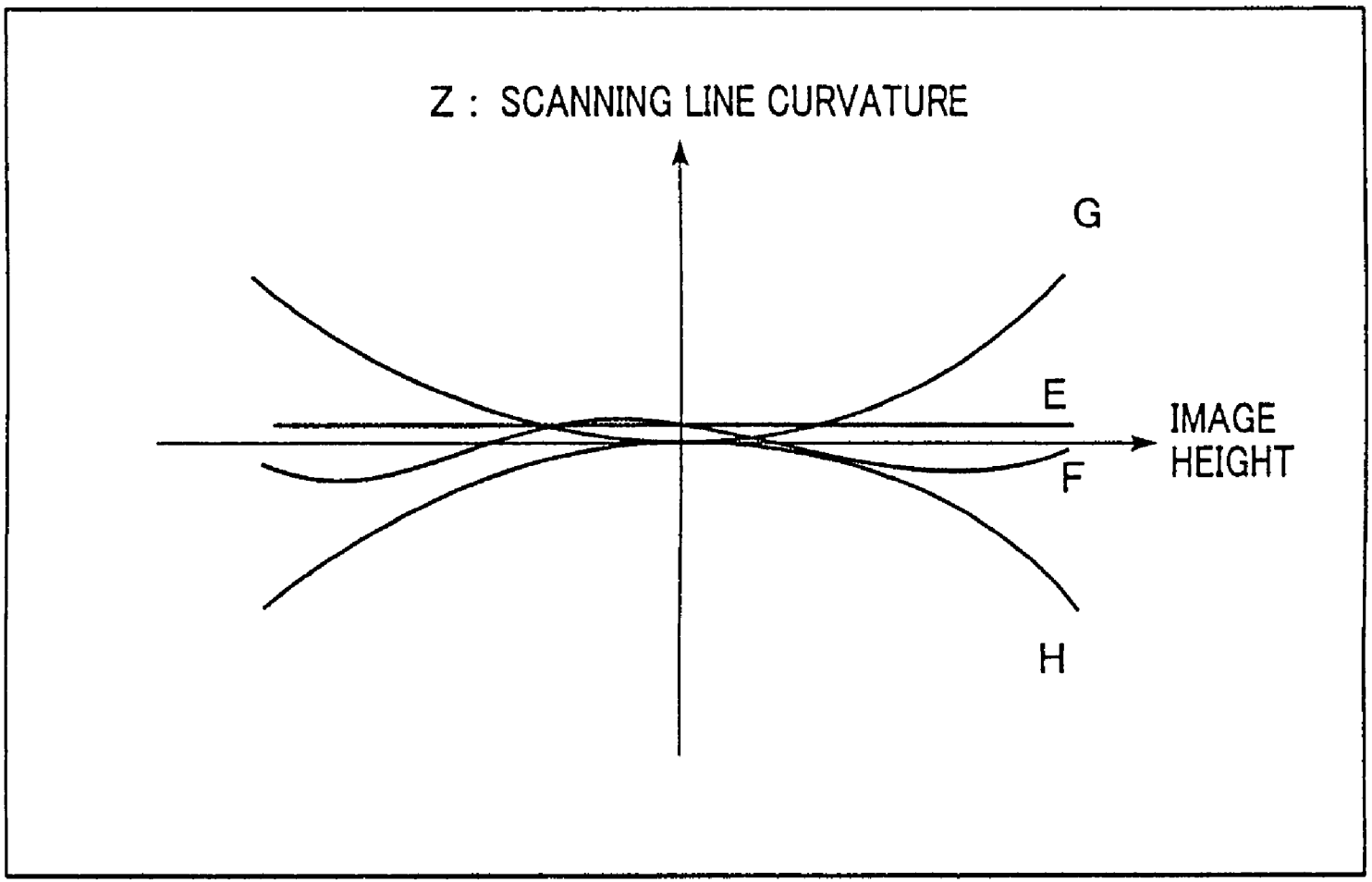
FIG. 5 illustrates variation in scanning line curvature in a second embodiment of the invention.

FIG. 5 is a descriptive view illustrating variation in the amount of the scanning line curvature caused by a cavity difference of the second scanning lens 6*b*. The second scanning lens 6*b* is formed with the four cavities E, F, G, and H. While the cavity lenses E and F show a variation in the amount of the scanning line curvature as represented by an error on an average level or smaller than the average, the G and H cavity lenses show a maximum variation in the amount of curvature. Therefore, when at least one each of the four optical scanning apparatuses has a cavity lens G or H mounted therein, the amount of color shift in the sub-scanning direction caused by the second scanning lens becomes maximum. Therefore, this configuration is not desirable.

In this embodiment, when using the cavity lenses G and H for the four optical scanning apparatuses provided in a single color image forming apparatus, it is desirable that as many as possible apparatuses are formed with the identical cavities G or H. There may however be a case where four cavities G or H are not available under particular manufacturing conditions. The amount of color shift caused by variation in scanning line curvature is therefore reduced by permitting formation of the cavity lenses E and F with almighty cavities, and combination thereof with cavities G and H.

In this embodiment, as is clear from the above description, for a cavity lens of which variation in the amount of the scanning line curvature caused by a cavity difference of the scanning lens formed with the plurality of cavities E, F, G, and H is represented by an error on an average level or smaller than the average, the color shift in the sub-scanning direction can be reduced by permitting combination with any of all the other cavities within a single color image forming apparatus, thereby achieving a color image forming apparatus which gives a satisfactory color image output.

Third Embodiment

A third embodiment of the present invention will now be described. Differences from the aforementioned first embodiment will mainly be described.

Figure 21:
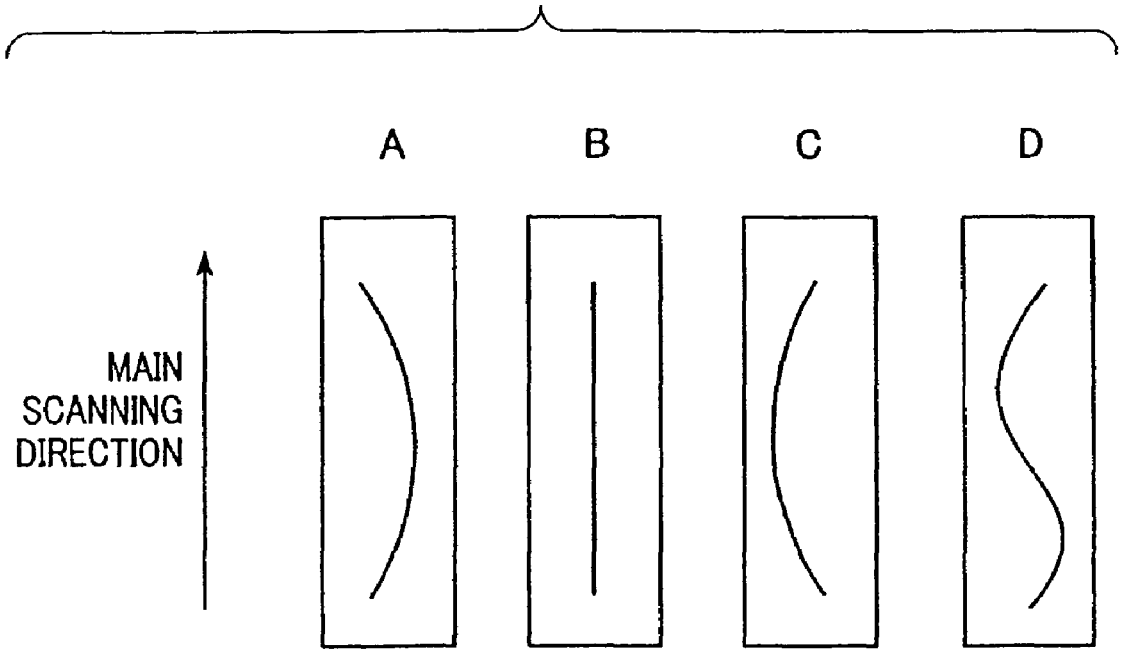
FIG. 21 illustrates scanning lens single-unit accuracy error (in the sub-scanning direction).

In this embodiment, from among the first and second scanning lenses 6*a* and 6*b* forming a scanning lens system 6 arranged in each optical scanning apparatus, the second scanning lens 6*b* is formed with a plurality of cavities A, B, C, and D shown for example in FIG. 19, and as shown in FIG. 21, the face apex height in the sub-scanning direction has a single-unit accuracy error such as curvature along the main scanning direction.

Figure 6:
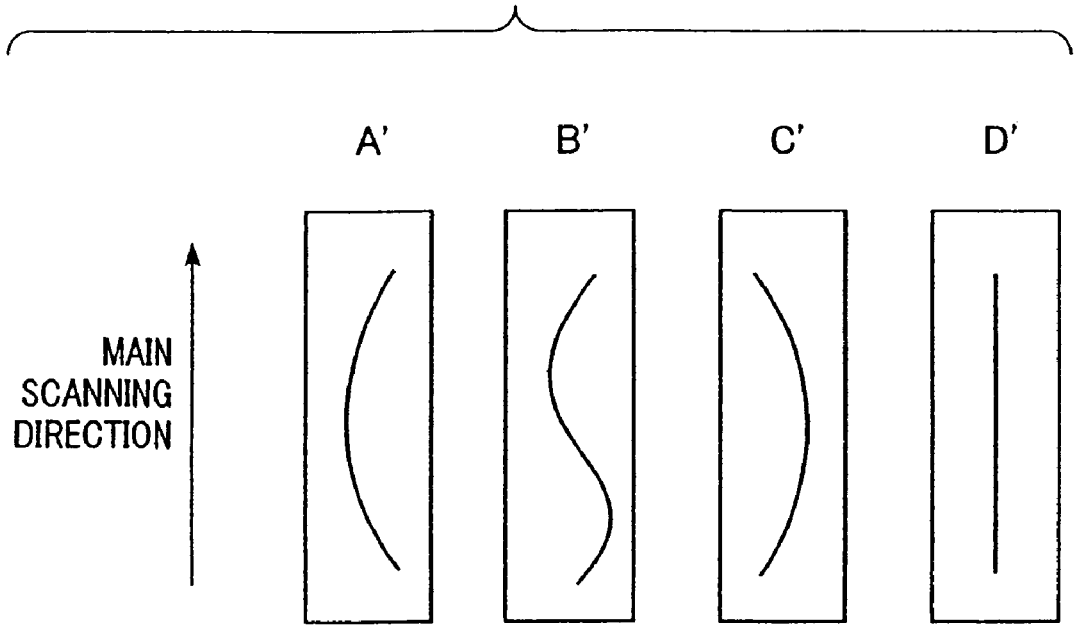
FIG. 6 illustrates scanning lens single-unit accuracy errors (in the sub-scanning direction) in a third embodiment of the invention.

The first scanning lens 6*a* is also formed with a plurality of cavities A', B', C,' and D', and as shown in FIG. 6, the face apex height in the sub-scanning direction has a single-unit accuracy error such as curvature along the main scanning direction.

Regarding the curving direction of the scanning line curvature caused by a cavity difference of the first and second scanning lenses 6*a* and 6*b* formed with the plurality of cavities, the amount of scanning line curvature in the entire scanning lens system is reduced by combining cavities so that the two scanning lenses are formed with cavities curving in counter directions.

Figure 7:
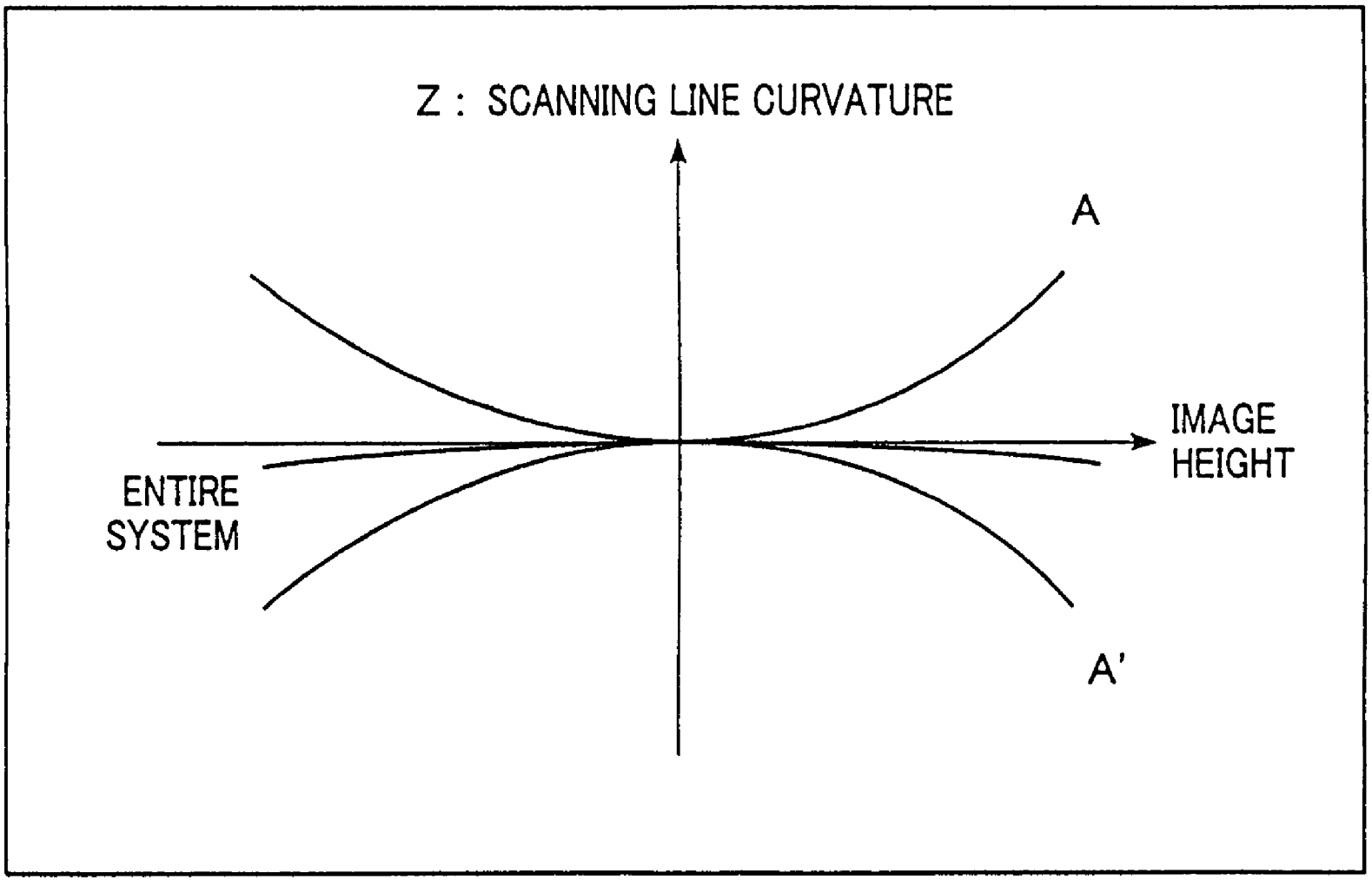
FIG. 7 illustrates scanning line curvature in the third embodiment of the invention.

FIG. 7 is a descriptive view illustrating the amount of scanning line curvature caused by A' and A when using the cavity A' for the first scanning lens 6*a* and the cavity A for the second scanning lens 6*b* of the scanning lens system 6 and a state of the scanning lines in the entire scanning lens system. Since the directions of the scanning line curvature caused by A' and A are reverse to each other, combination thereof leads to the scanning line curvature in reverse directions, resulting in reduction of the amount of curvature. The same effect is available by combining cavities C' and C.

In this embodiment, as is clear from the above description, regarding the curving direction of scanning line curvature caused by a cavity difference of the scanning lenses formed with a plurality of cavities, the amount of scanning line curvature can be reduced in the entire scanning lens system by combining the cavities so as to build at least two scanning lenses with cavities of which the curving directions are counter to each other, and it is possible to reduce color shift in the sub-scanning direction, thereby achieving a color image forming apparatus giving a satisfactory color image output.

Fourth Embodiment

A fourth embodiment of the present invention will now be described. Differences from the aforementioned first embodiment will mainly be described.

In this embodiment, when cavities are divided into a plurality of groups so that a relative difference in optical parameter is within an allowable range according to the variation in the optical parameters (partial magnification in the main scanning direction) caused by a cavity difference of the lens formed with a plurality of cavities as described later, at least one lens for each scanning lens system is selected from cavities of one of the plurality of groups. The optical parameter is a partial magnification in the main scanning direction on the surface of the photosensitive drum, and the allowable range of the optical parameter is within 100 μm as represented by a relative difference in dot positional shift in the main scanning direction over the entire scanning region on the surface of the image carrier.

More specifically, in this embodiment, the second scanning lens 6*b* from among the first and second scanning lenses forming the scanning lens system 6 provided in each optical scanning apparatus is formed with the plurality of cavities A, B, C, and D shown in FIG. 19. For the cavity lens 6*b* for which the variation in the partial magnification in the main scanning direction caused by a cavity difference of the second scanning lens 6*b* formed with the plurality of cavities A, B, C, and D has a large error as compared with the maximum or the average, the four optical scanning apparatuses provided in a single color image forming apparatus are uniform in terms of cavities.

Figure 8:
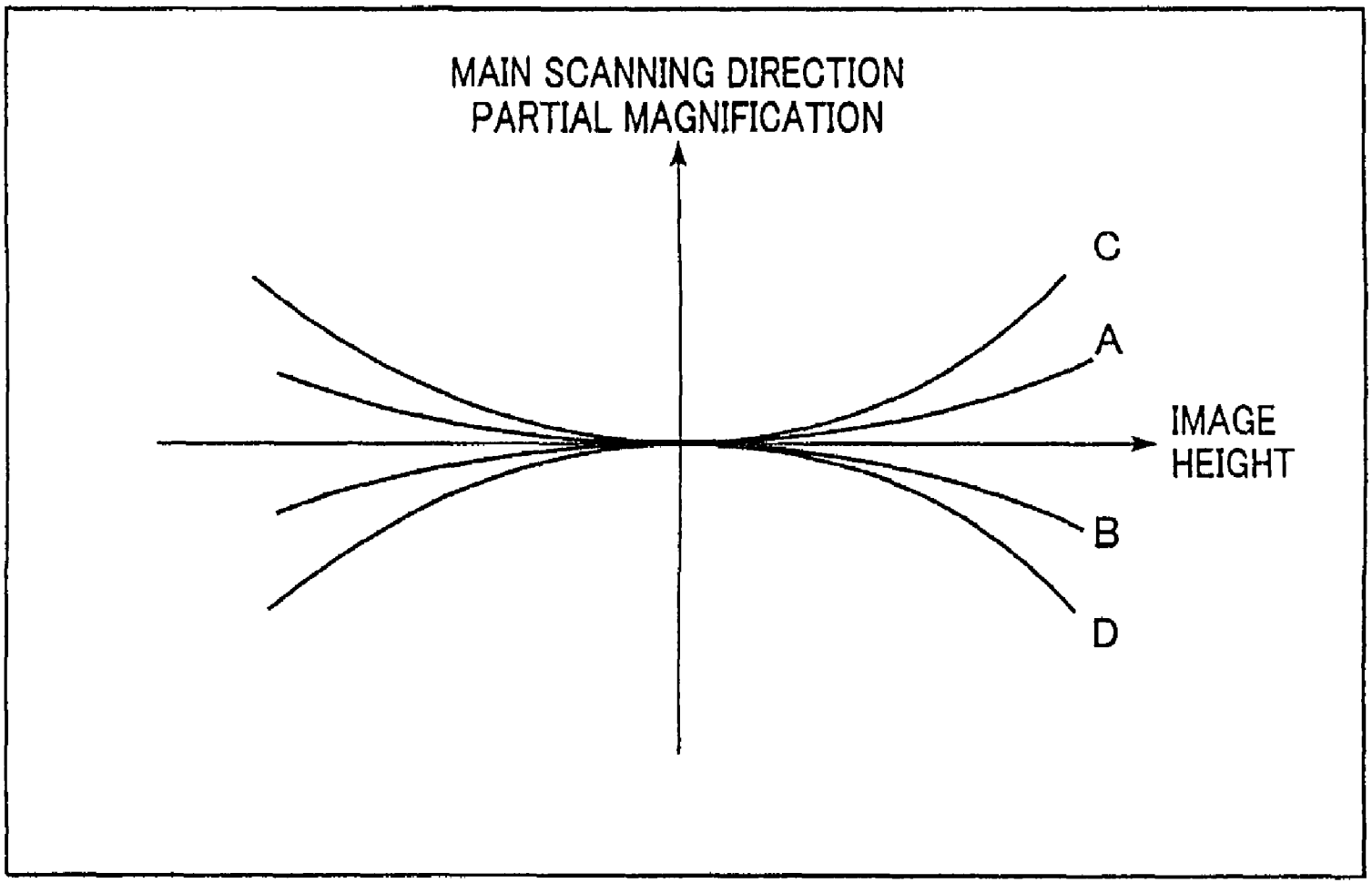
FIG. 8 illustrates partial magnification in the main scanning direction in a fourth embodiment of the invention.

FIG. 8 is a descriptive view illustrating variation in partial magnification in the main scanning direction caused by a cavity difference of the second scanning lens. The second scanning lens 6*b* is formed with four cavities A, B, C, and D. The cavity lenses of A and B, variation in partial magnification in the main scanning direction has an error on the average level over the four cavities or smaller than the average. For the cavity lenses of C and D, in contrast, the variation is maximum. Therefore, if there are two optical scanning apparatuses each having a cavity lens C or D mounted therein among the four optical scanning apparatuses, the amount of color shift in the main scanning direction caused by the second scanning lens 6*b* becomes maximum. Therefore, this configuration is not preferable.

In this embodiment, therefore, when C and D cavity lenses are used for all four optical scanning apparatuses provided in a single color image forming apparatus, the amount of color shift caused by the partial magnification difference in the main scanning direction can be reduced by causing all four apparatuses to be of the same cavity C or D. In this case, each one color image forming apparatus may be of A or B without using the uniform cavities.

In this embodiment, as described above, for a cavity lens for which the variation in partial magnification in the main scanning direction caused by a cavity difference of the scanning lenses formed with the plurality of cavities A, B, C, and D, in which the error is maximum or large relative to the average, color shift in the main scanning direction can be reduced by using uniform cavities (cavity C or D) for all the plurality of optical scanning apparatuses provided in a single color image forming apparatus, thereby achieving a color image forming apparatus giving a satisfactory color image output.

Fifth Embodiment

A fifth embodiment of the present invention will now be described. Differences from the above-mentioned fourth embodiment will mainly be described.

In this embodiment, when cavities are divided into a plurality of groups so that the relative difference in an optical parameter is within an allowable range in response to the variation in the optical parameters (partial magnification in the main scanning direction) caused by a cavity difference of the lenses formed with a plurality of cavities, cavities are selected from one of these groups for a single color image forming apparatus, and each of the plurality of groups has at least one cavity belonging to all the plurality of groups.

More specifically, in this embodiment, the second scanning lens 6*b* from among the first and second scanning lenses 6*a* and 6*b* forming the scanning lens system 6 arranged in each optical scanning apparatus is formed, for example, by using a plurality of cavities E, F, G, and H shown in FIG. 20. For the cavity lens 6*b* for which the variation in partial magnification in the main scanning direction caused by a cavity difference of the second scanning lens 6*b* formed with the plurality of cavities E, F, G, and H is such that the error is on an average level or smaller than the average, it is possible to combine with any of all the other cavities within a single color image forming apparatus.

Figure 9:
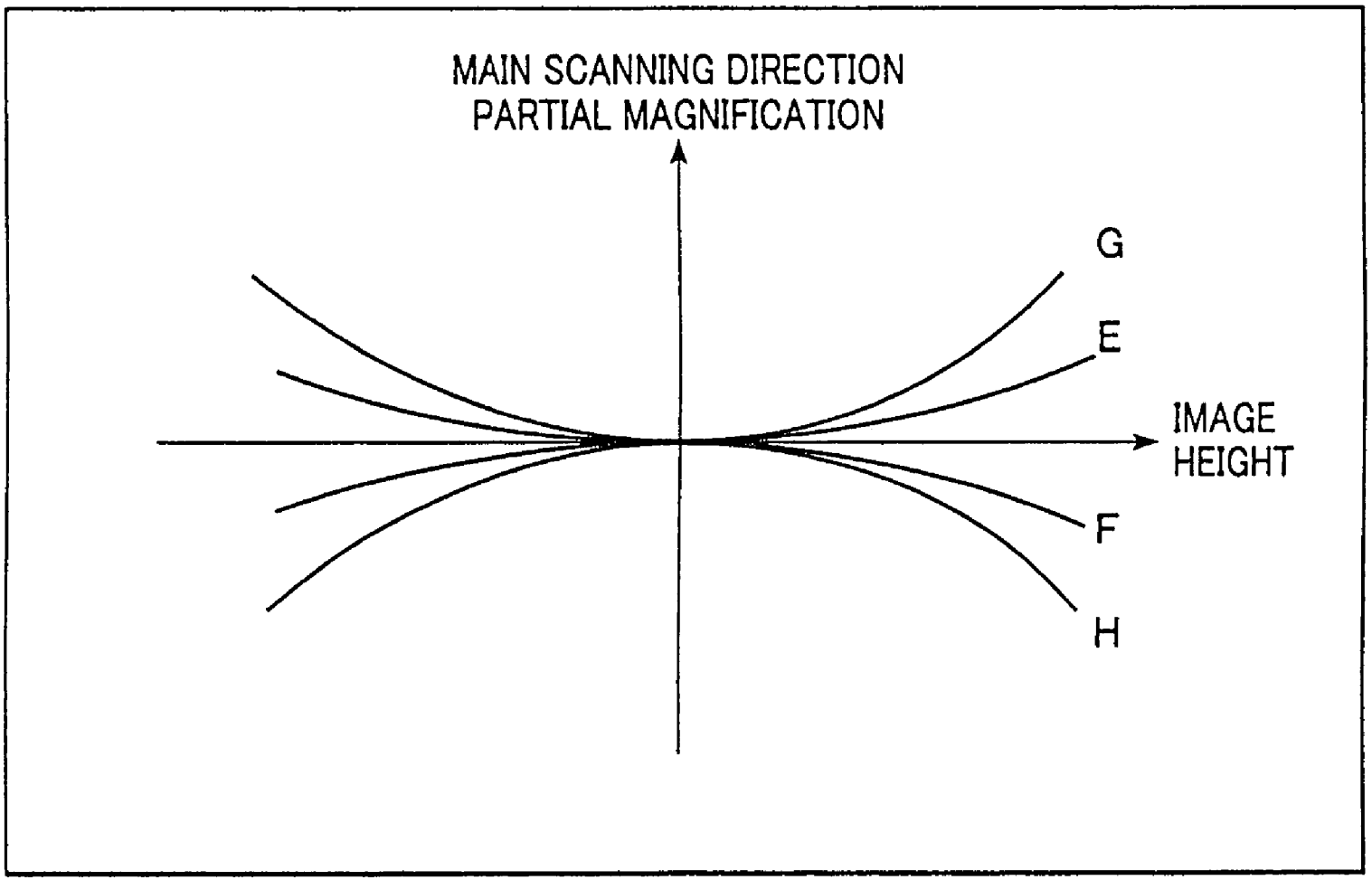
FIG. 9 illustrates partial magnification in the main scanning direction in a fifth embodiment of the invention.

FIG. 9 is a descriptive view illustrating the variation in partial magnification in the main scanning direction caused by a cavity difference of the second scanning lens 6*b*. The second scanning lens 6*b* is formed with four cavities E, F, G, and H. The cavity lenses of E and F have a variation in partial magnification in the main scanning direction as represented by an error on an average level over the four, or smaller than the average. For the G and H cavity lenses, in contrast, the variation in the partial magnification is maximum. Therefore, if there are a scanning optical apparatus mounting a G cavity lens and another mounting an H cavity lens among the four optical scanning apparatuses, the amount of color shift in the main scanning direction caused by the second scanning lens 6*b* becomes maximum. Therefore, this configuration is not desirable.

In this embodiment, therefore, when using G and H cavity lenses for the four optical scanning apparatuses provided in a single color image forming apparatus, it is desirable that as many as possible optical scanning apparatuses use a single kind of cavity G or H. Cavities G or H in a number sufficient for the four optical scanning apparatus may not be available under manufacturing circumstances. The amount of color shift caused by the partial magnification in the main scanning direction is reduced by making it possible to combine E and F cavity lenses serving as almighty cavities with G and H cavities.

In this embodiment, as described above, for a cavity lens for which the variation in the partial magnification caused by a cavity difference of the scanning lenses formed with a plurality of cavities E, F, G, and H shows an error on the average level or smaller than the average, color shift in the main scanning direction can be reduced by permitting combination with any of all the other cavities within a single color image forming apparatus, thereby achieving a color image forming apparatus giving a satisfactory color image output.

Sixth Embodiment

A sixth embodiment of the present invention will now be described. Differences from the above-mentioned fourth embodiment will mainly be described.

Figure 22:
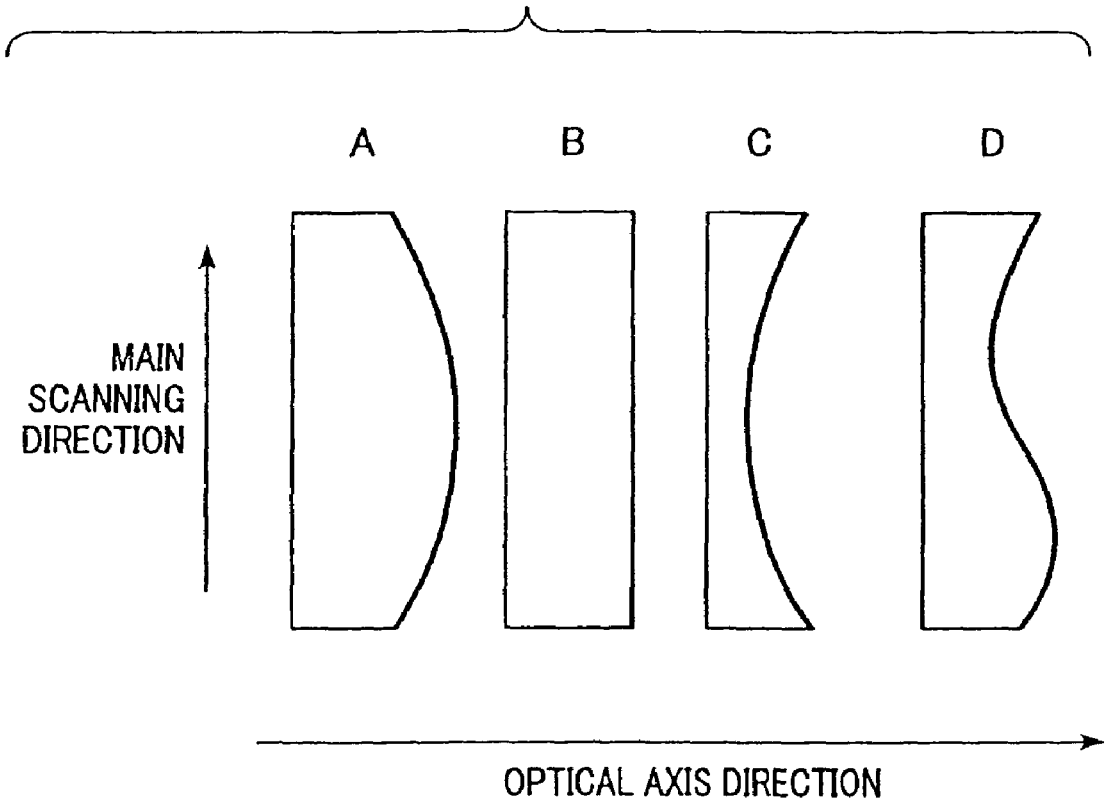
FIG. 22 illustrates scanning lens single-unit accuracy error (in the main scanning direction).

In this embodiment, a second scanning lens 6*b* from among the first and second scanning lenses 6*a* and 6*b* forming a scanning lens system 6 provided in each optical scanning apparatus is formed, for example, with a plurality of cavities A, B, C, and D shown in FIG. 19, and the geometric surface in the main scanning direction has a single-unit accuracy error such as curvature along the main scanning direction, as shown in FIG. 22.

Figure 10:
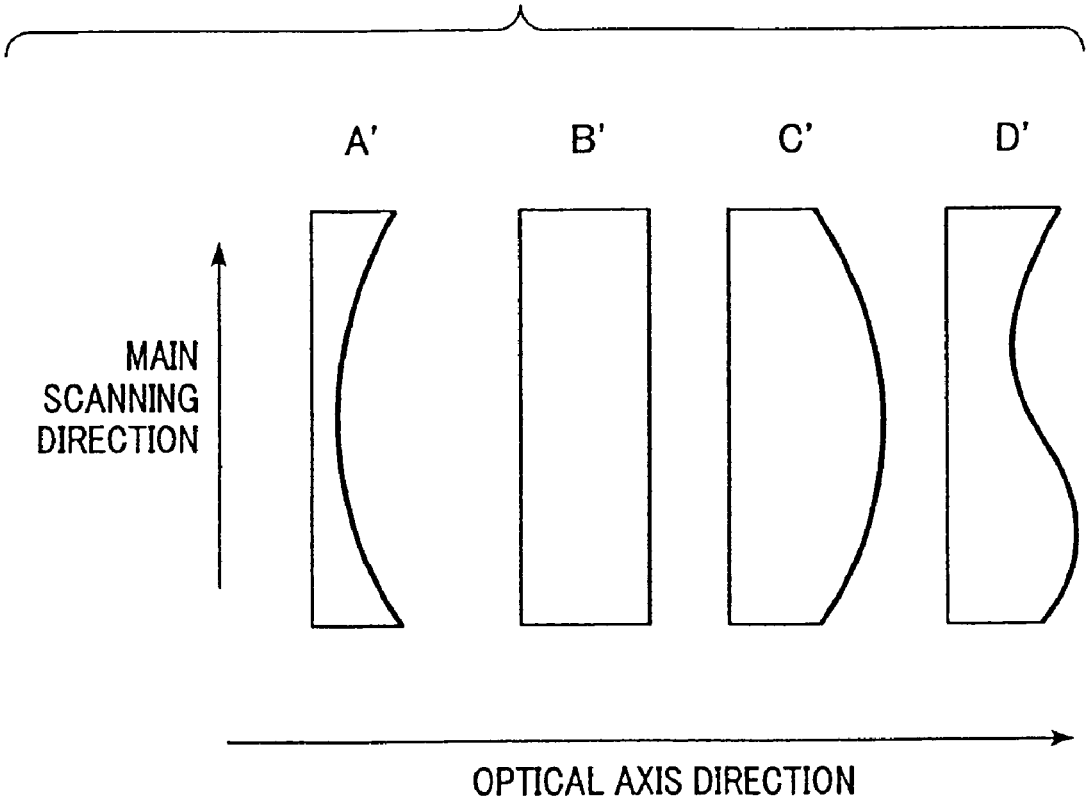
FIG. 10 illustrates scanning lens single-unit accuracy errors (in the main scanning direction) in a sixth embodiment of the invention.
Figure 23:
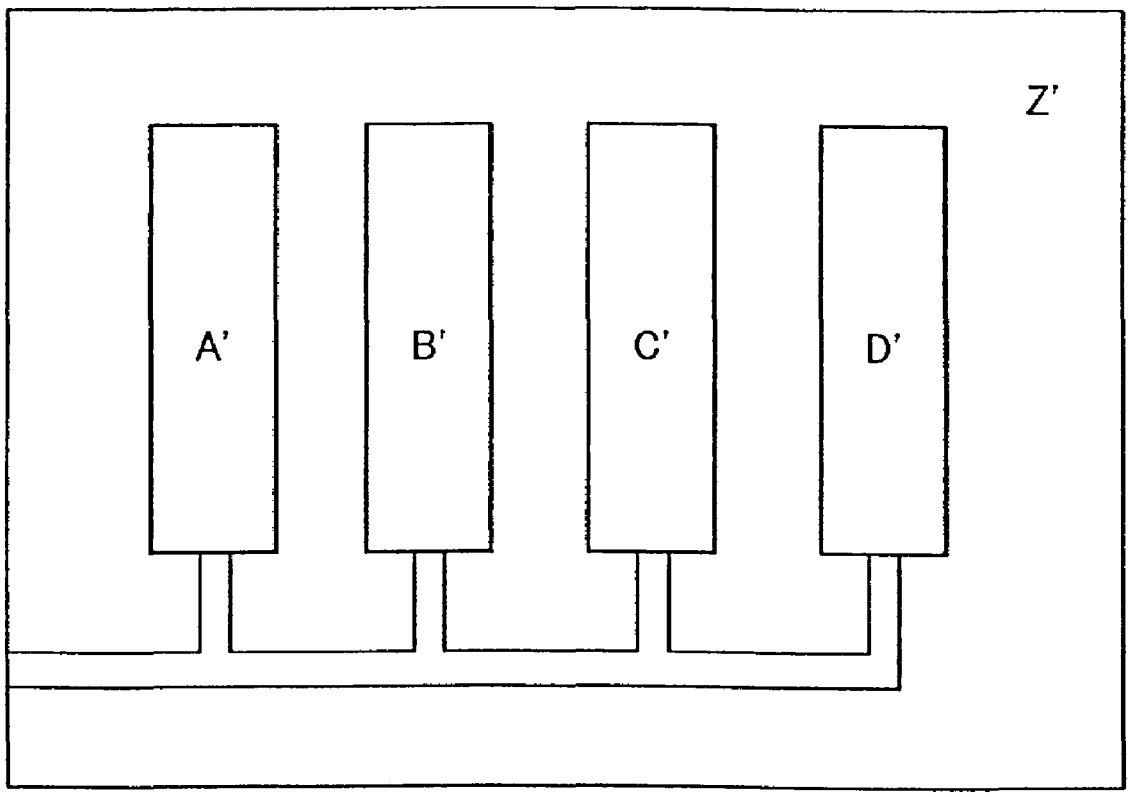
FIG. 23 illustrates a mold having a plurality of cavities.

The first scanning lens 6*a* is also formed with a plurality of cavities A', B', C', and D' shown in FIG. 23, and the geometric surface in the main scanning direction has a single-unit accuracy error such as curvature along the main scanning direction as shown in FIG. 10.

Regarding the error direction of the partial magnification in the main scanning direction caused by a cavity difference of the first and second scanning lenses 6*a* and 6*b* formed with a plurality of cavities, the partial magnification in the main scanning direction over the entire scanning lens system is reduced by combining cavities so as to form two scanning lenses with cavities having error directions of the partial magnification counter to each other.

Figure 11:
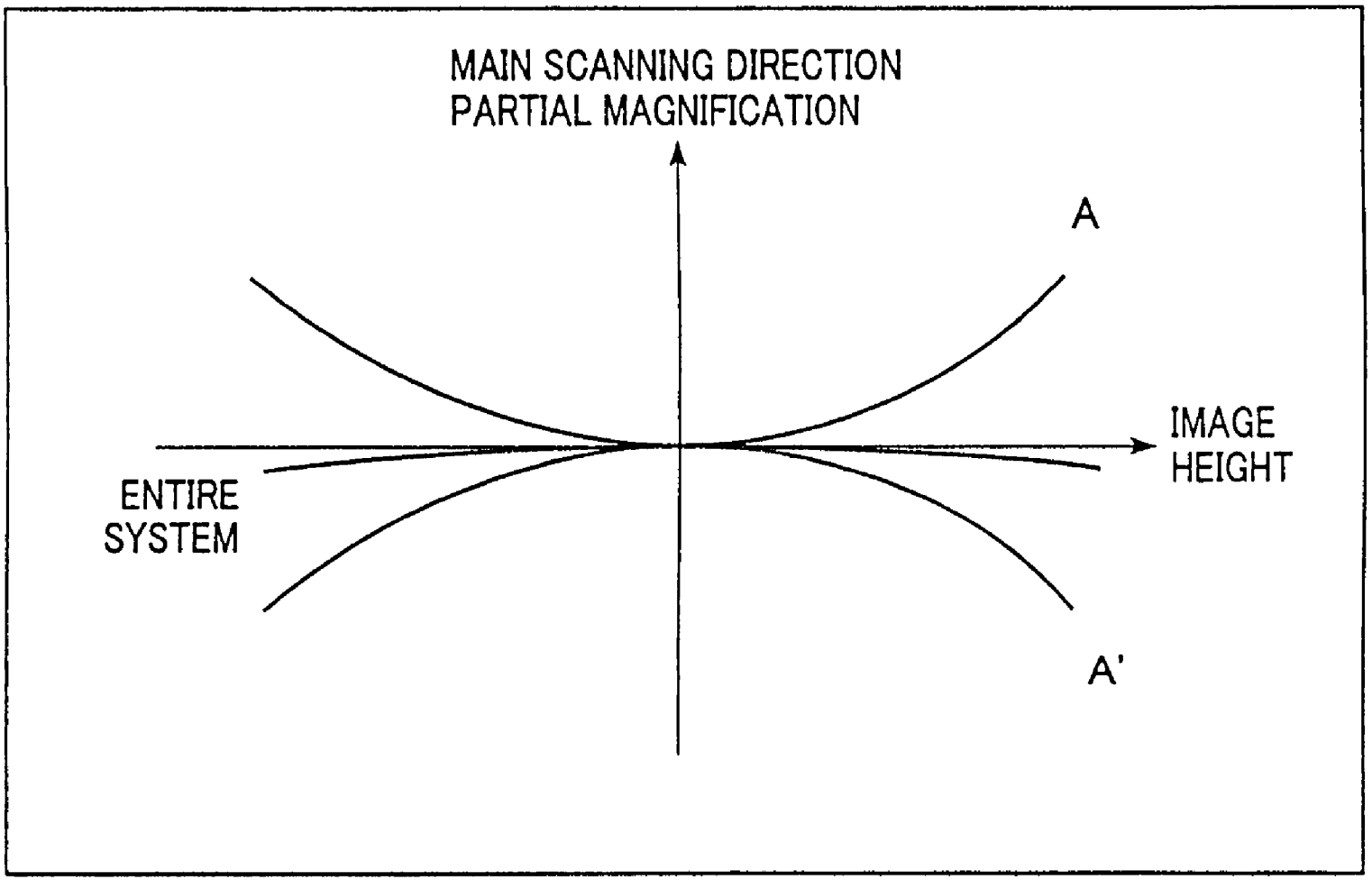
FIG. 11 illustrates partial magnification in the main scanning direction in the sixth embodiment of the invention.

FIG. 11 is a descriptive view illustrating, in the scanning lens system 6, the first scanning lens 6*a* formed with cavity A', the second scanning lens 6*b* formed with cavity A, the amount of partial magnification in the main scanning direction caused by A' and A, and the state of the partial magnification over the entire scanning lens system. Because the error directions of the partial magnification in the main scanning direction caused by A' and A are counter to each other, combination thereof offsets the partial magnification, resulting in reduction of the amount of partial magnification. Similarly, combination of cavities C' and C provides the same effect.

In this embodiment, as described above, regarding the partial magnification in the main scanning direction caused by a cavity difference of the scanning lenses formed with the plurality of cavities, the partial magnification error over the entire scanning lens system can be reduced by combining at least the two scanning lenses with cavities having partial magnification error directions counter to each other. It is also possible to reduce color shift in the main scanning direction, thereby achieving a color image forming apparatus giving a satisfactory color image output.

Seventh Embodiment

A seventh embodiment of the present invention will now be described. This embodiment has a combined configuration of the aforementioned first and fourth embodiments.

More specifically, in this embodiment, the second scanning lens 6*b*, from among the first and second scanning lenses 6*a* and 6*b* forming the scanning lens system 6 provided in each scanning optical apparatus is formed, for example, with a plurality of cavities A, B, C, and D shown in FIG. 19. For the cavity lens 6*b* for which the variation in the amount of scanning line curvature caused by a cavity difference of the second scanning lens 6*b* formed with the plurality of cavities A, B, C, and D and the variation in the partial magnification in the main scanning direction is maximum or larger than the average, all four optical scanning apparatuses provided in a single color image forming apparatus are of the same kind of cavity.

Figure 12A:
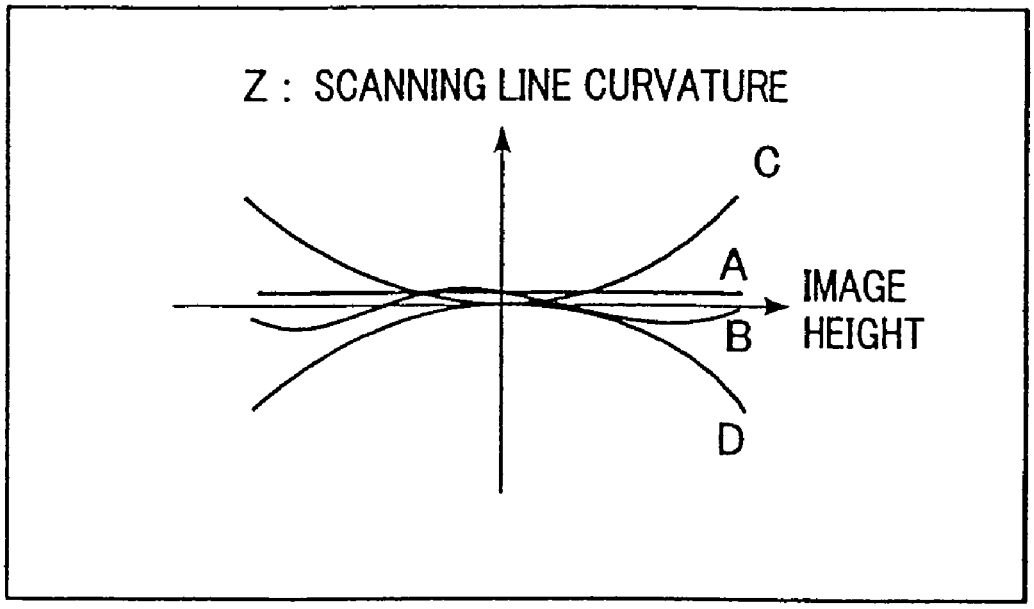
FIG. 12 illustrates variation in the scanning line curvature and partial magnification in the main scanning direction in a seventh embodiment of the invention.
Figure 12B:
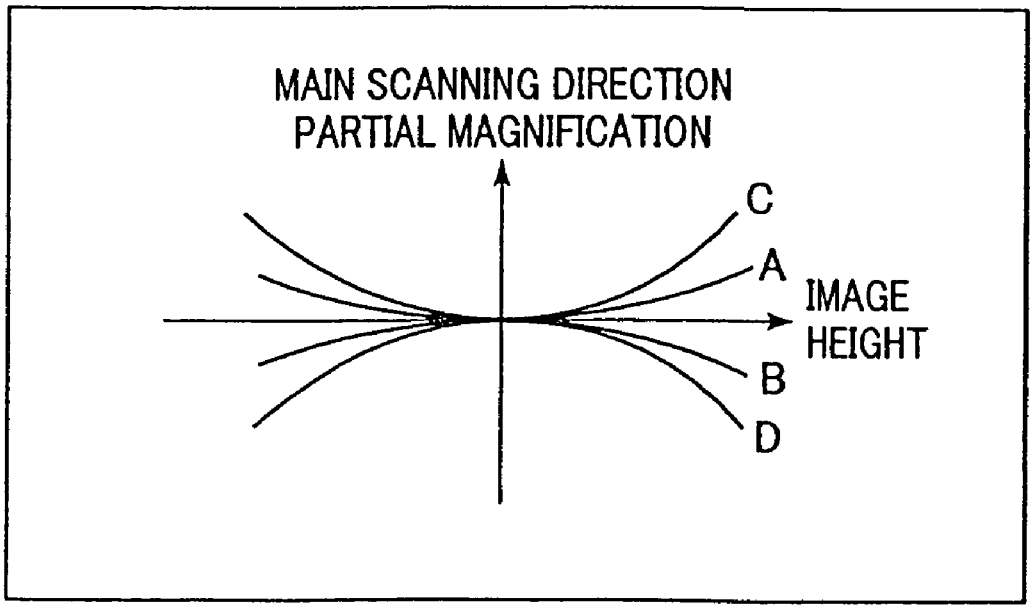

FIGS. 12(A) and 12(B) are descriptive views illustrating dispersion of the amount of scanning line curvature and variation in the partial magnification in the main scanning direction, caused by a cavity difference of the second scanning lens 6*b*, respectively. The second scanning lens 6*b* is formed with four cavities A, B, C, and D. In the A and B cavity lenses, the variation in the amount of curvature of scanning line curvature and the variation in the partial magnification in the main scanning direction are on an average level over the four or show a small error relative to the average. In the C and D cavity lenses, in contrast, the variation the amount of curvature and the variation in the partial magnification are maximum. Therefore, if at least one apparatus which mounts C and D cavity lenses from among the four optical scanning apparatuses, the amount of color shift in the sub-scanning direction and in the main scanning direction caused by the second scanning lens 6*b* becomes maximum. Therefore, this configuration is not therefore desirable.

In this embodiment, when C and D cavity lenses are used for all four optical scanning apparatuses provided in a single color image forming apparatus, the amount of color shift caused by a difference in scanning line curvature and a difference in partial magnification are reduced by using a kind of cavity of C or D for all four optical scanning apparatuses. For the A and B cavity lenses, a single color image forming apparatus may comprise A and B, without using a single kind of cavity.

In this embodiment, as described above, for a cavity lens for which the variation in the amount of scanning line curvature caused by a cavity difference of the scanning lenses formed with the plurality of cavities A, B, C, and D and the variation in the partial magnification in the main scanning direction are maximum or have a large error relative to the average, color shift in the sub-scanning direction and in the main scanning direction can be reduced by using identical cavities for all the plurality of optical scanning apparatuses provided in a single color image forming apparatus, thereby achieving a color image forming apparatus providing a satisfactory color image output.

Eighth Embodiment

An eighth embodiment of the present invention will now be described. This embodiment has a configuration comprising a combination of the aforementioned second and fifth embodiments.

More specifically, in this embodiment, from among first and second scanning lenses 6*a* and 6*b* forming a scanning lens system 6 provided in each optical scanning apparatus, the second scanning lens 6*b* is formed with, for example, a plurality of cavities E, F, G, and H shown in FIG. 20. For the cavity lens 6*b* for which the variation in the amount of scanning line curvature caused by a cavity difference of the second scanning lens 6*b* formed with the plurality of cavities E, F, G, and H and the variation in partial magnification in the main scanning direction are on an average level or have an error smaller than the average, it is made possible to combine with any of all the other cavities within a single color image forming apparatus.

Figure 13A:
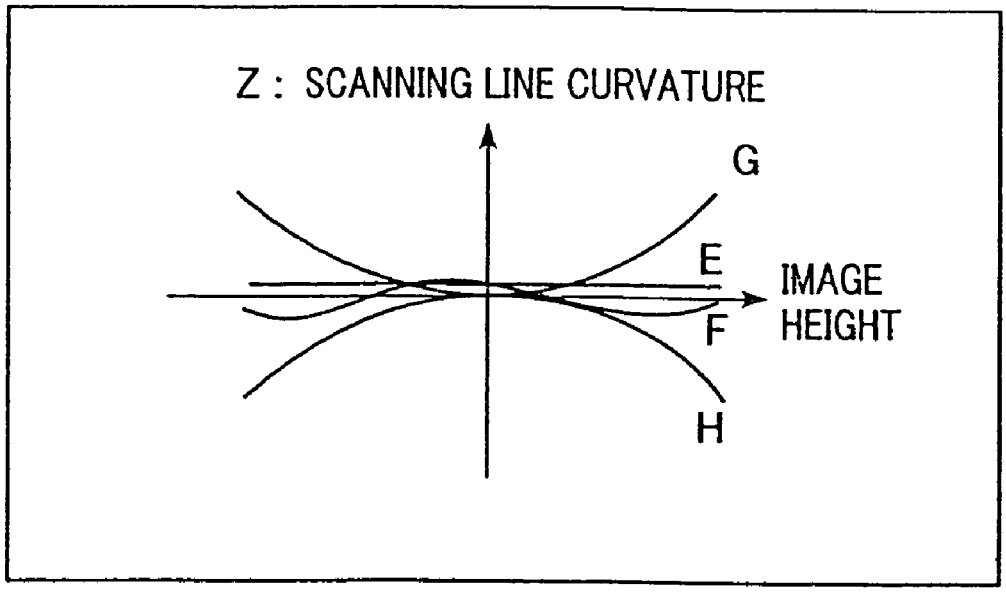
FIG. 13 illustrates variation in the scanning line curvature and variation in partial magnification in the main scanning direction in an eighth embodiment of the invention.
Figure 13B:
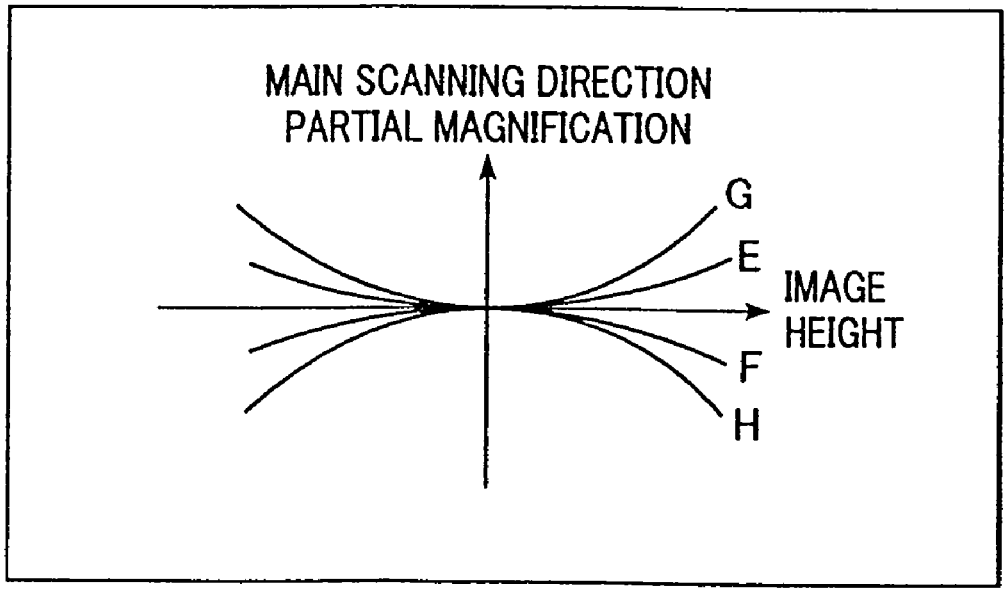

FIGS. 13(A) and 13(B) are descriptive views illustrating variation in the amount of scanning line curvature and variation in the partial magnification in the main scanning direction, caused by a cavity difference of the second scanning lens 6*b*, respectively. The second scanning lens 6*b* is formed with four cavities E, F, G and H. In the cavity lenses E and F, the variation in the amount scanning line curvature and the variation in the partial magnification in the main scanning direction are on an average level over the four or show only a small error relative to the average. In the G and H cavity lenses, in contrast, the variation in the amount of curvature and the variation in the partial magnification are maximum. Therefore, if at least one apparatus which mounts G and H cavity lenses from among the four optical scanning apparatuses, the amount of color shift in the sub-scanning direction and in the main scanning direction caused by the second scanning lens 6*b* becomes maximum. Therefore, this configuration is not desirable.

In this embodiment, therefore, when using G and H cavity lenses for the four scanning optical apparatuses provided in one color image forming apparatus, it is desirable to use identical cavities G or H for as many as possible apparatuses. It is however probable that a necessary number of cavities G or H cannot be provided for four apparatuses under some manufacturing circumstances. The amount of color shift caused by a scanning line curvature difference and a partial magnification difference is reduced by making it possible to use the cavities G and H as almighty cavities, and combine cavities G and H.

In this embodiment, as described above, for a cavity lens for which the variation in the amount of scanning line curvature and the variation in partial magnification in the main scanning direction caused by a cavity difference of the scanning lenses formed with the plurality of cavities E, F, G, and H are on an average level, or have only a small error relative to the average, color shift in the sub-scanning direction and in the main scanning direction can be reduced by making it possible to combine with any of all the other cavities in a single color image forming apparatus, thereby achieving a color image forming apparatus providing a satisfactory color image output.

Ninth Embodiment

A ninth embodiment of the present invention will now be described. This embodiment has a configuration comprising a combination of the aforementioned third and sixth embodiments.

More specifically, in this embodiment, from among first and second scanning lenses 6*a* and 6*b* forming a scanning lens system 6 arranged in each optical scanning apparatus, the second scanning lens 6*b* is formed, for example, with a plurality of cavities A, B, C, and D shown in FIG. 19, and the face apex height in the sub-scanning direction and the geometric surface in the main scanning direction have a single-unit accuracy error such as curvature along the main scanning direction as shown in FIGS. 21 and 22.

The first scanning lens 16*a* is also formed with a plurality of cavities A', B', C', and D' shown in FIG. 23, and the face apex height in the subs-scanning direction and the geometric surface in the main scanning direction have a single-unit accuracy error such as curvature along the main scanning direction as shown in FIGS. 6 and 10.

The amount of scanning line curvature and the partial curvature in the main scanning direction over the entire scanning lens system are reduced by combining cavities so as to form two scanning lens with cavities having a reverse curving direction and a reverse error direction of the partial magnification, regarding the curving direction of the scanning line curvature and the error direction of the partial magnification in the main scanning direction caused by a cavity difference of the first and second scanning lenses 6*a* and 6*b* formed with the plurality of cavities.

Figure 14A:
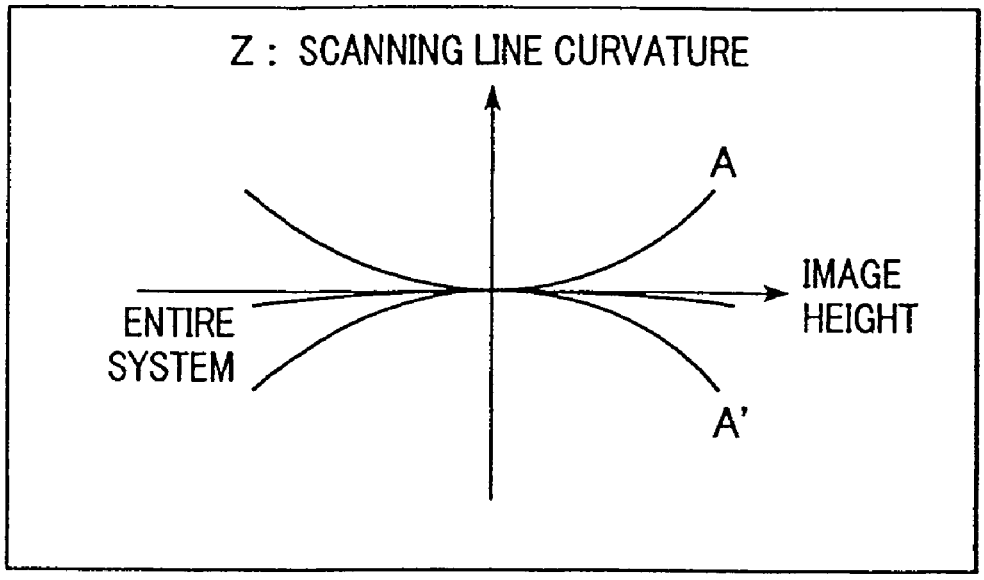
FIG. 14 illustrates scanning line curvature and partial magnification in the main scanning direction in a ninth embodiment of the invention.
Figure 14B:
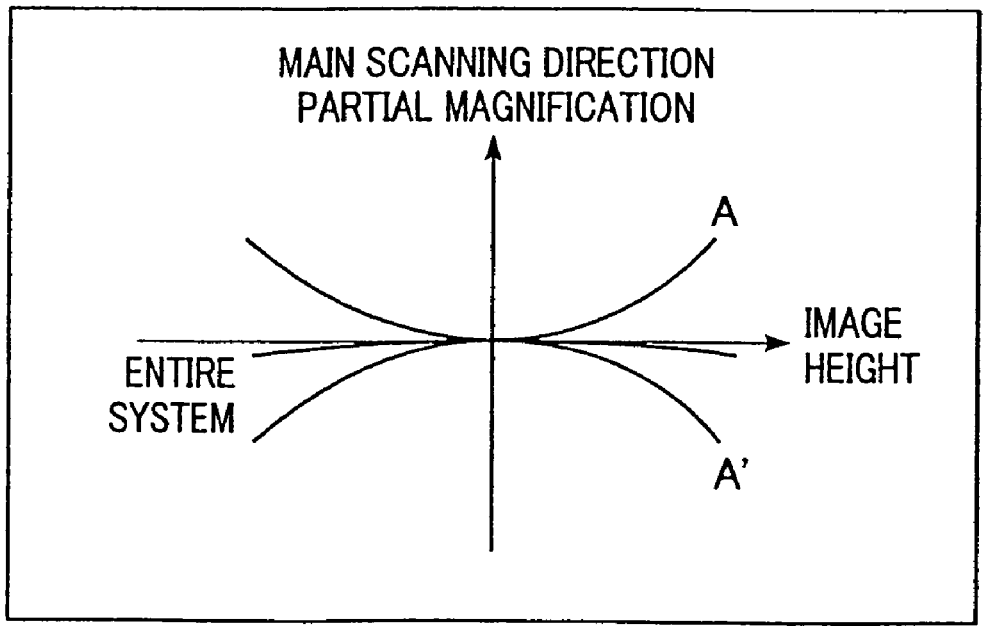
Figure 15:
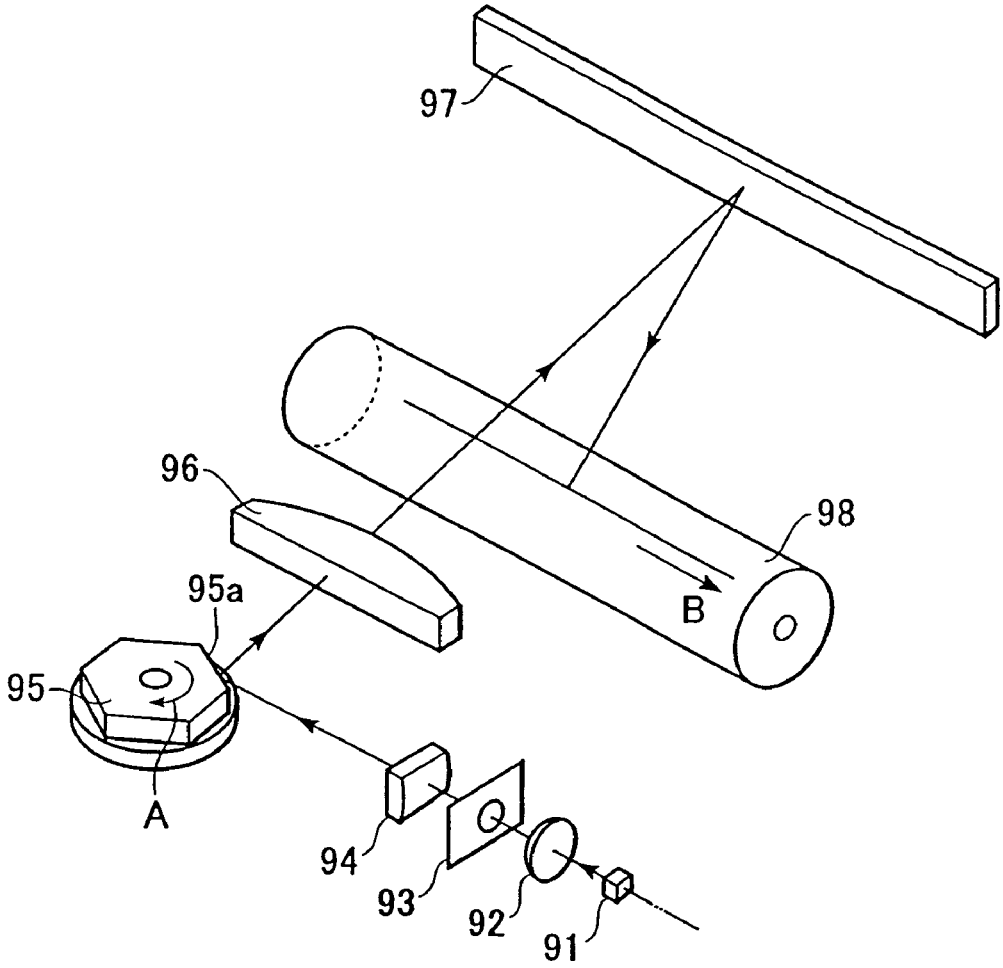
FIG. 15 is a partial schematic view of a conventional optical scanning apparatus.
Figure 16:
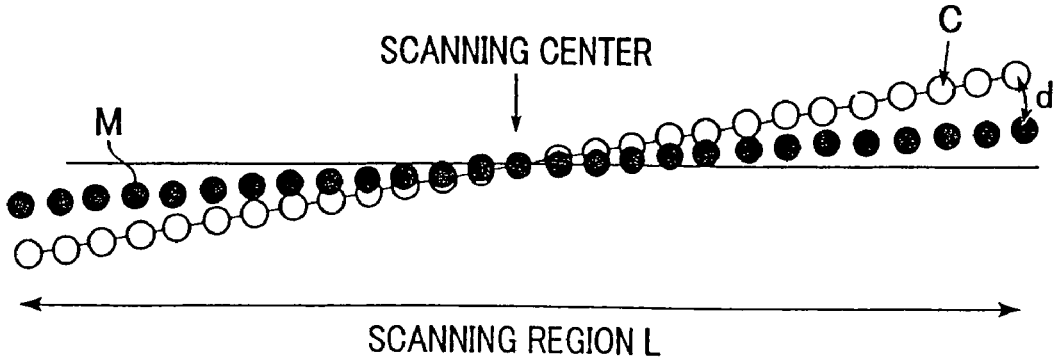
FIG. 16 illustrates a state before adjustment of the scanning line inclination.
Figure 17:
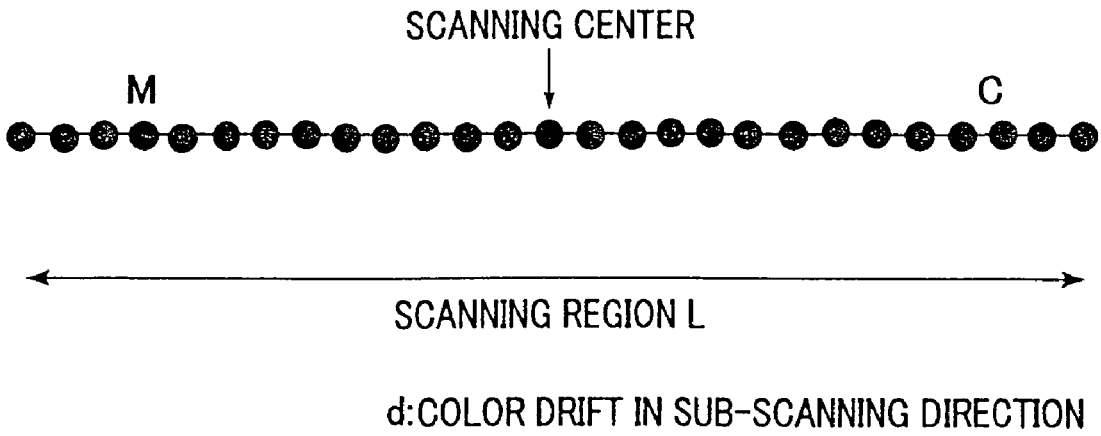
FIG. 17 illustrates a state after adjustment of the scanning line inclination.
Figure 18:
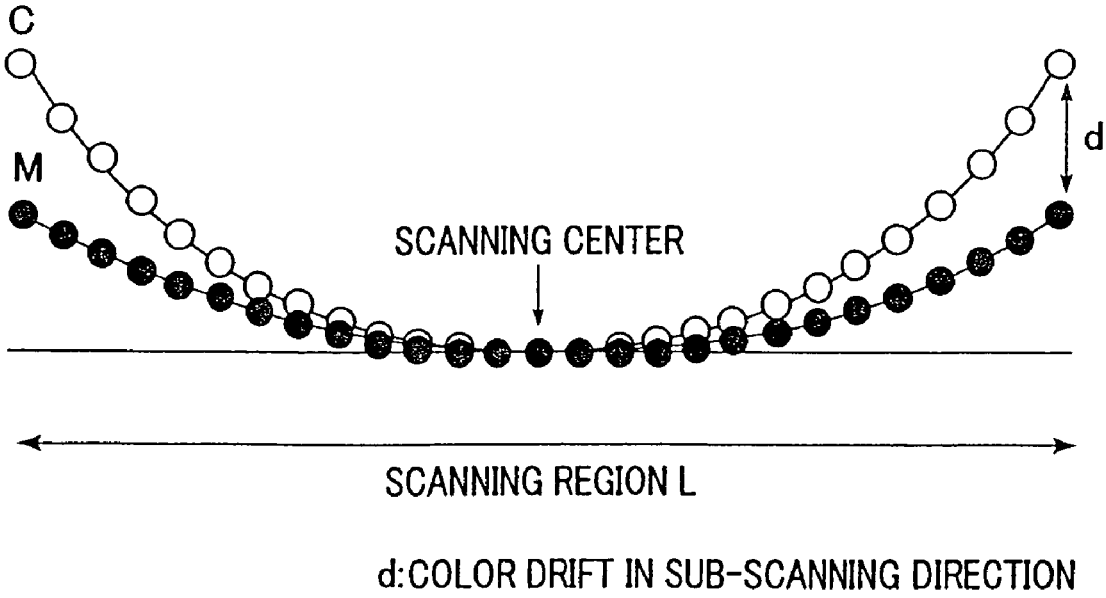
FIG. 18 illustrates scanning line curvature.

FIGS. 14(A) and 14(B) are descriptive views illustrating the amount of scanning line curvature and the partial magnification caused by A' and A, and the state of scanning lines and the partial magnification over the entire scanning lens system in a case where the first scanning lens 6*a* is formed with cavity A' and the second scanning lens 6*b* is formed with cavity A in the scanning lens system 6, respectively.

Since directions of the scanning line curvature and the partial magnification caused by A' and A are counter to each other, combination thereof leads to a direction offsetting the scanning line curvature and the partial magnification, resulting in reduction of the amount of curvature and the partial magnification. Similarly, combination of cavities C' and C provides the same effect.

In this embodiment, as described above, it is possible to reduce the amount of scanning line curvature and the partial magnification error by forming at least the first and the second scanning lenses 6*a* and 6*b* with combined cavities having a curving direction and partial magnification error direction counter to each other, regarding the direction of the scanning line curvature and the direction of the partial magnification in the main scanning direction caused by a cavity difference of the scanning lenses formed with the plurality of cavities. It is also possible to reduce color shift in the sub-scanning direction and in the main scanning direction, thereby achieving a color image forming apparatus bringing about a satisfactory color image output.

According to the present invention, as described above, in an image writing apparatus having a plurality of scanning optical systems used for a color image forming apparatus which forms an image by using a plurality of image carriers, when forming at least one lens of identical optical parameters of the scanning optical system corresponding to individual image carriers with a plurality of cavities, and dividing the cavities into a plurality of groups so that a relative difference in optical parameter is within an allowable range, according to the variation in optical parameters caused by a cavity difference of the lens formed with the plurality of cavities; it is possible to reduce the dot positional shift in the sub-scanning direction or/and in the main scanning direction over the entire scanning region on the surface of the image carrier, and to achieve a color image forming apparatus capable of providing a satisfactory color image containing only a few color shift components in the sub-scanning or/and the main scanning direction; by selecting one lens of each scanning optical system from cavities of one group from among the plurality of groups; or selecting cavities from one group for one image writing apparatus, and causing the plurality of groups to have at least one cavity belonging thereto.

What is claimed is:

1. A method of manufacturing an image writing apparatus, wherein the image writing apparatus comprises plural scanning optical systems, each scanning optical system for forming individual ones of plural images on respective ones of plural image carriers by scanning the image carriers with respective ones of plural beams, wherein each scanning optical system includes a lens having optical characteristics identical to those of corresponding lenses in all others of the plural scanning optical systems, wherein said method comprises:

forming the plurality of lenses having identical optical characteristics by use of a plurality of cavities which are divided into plural groups of cavities;

forming individual ones of the plural scanning optical systems by using the formed lenses;

wherein the plurality of lenses having identical optical characteristics have relative differences in a value of the optical characteristics which are not within an allowable range, wherein the plurality of cavities are divided into the plural groups of cavities according to variations in the optical characteristics of the plurality of lenses formed by use of the plurality of cavities so that the relative differences in the value of the optical characteristics are within the allowable range, wherein the lenses of the individual scanning optical systems are formed from cavities of one of the plural groups, and wherein the allowable range of the relative differences of the lenses in the value of the optical characteristics is that a relative difference of an irradiating position height is 100 μm or less in an entire scanning region on the image carriers, or the allowable range of the relative differences of the lenses in the value of the optical characteristics is that a relative difference in dot positional shift in a main scanning direction is 100 μm or less in the entire scanning region on the image carriers.

2. A method of manufacturing an image writing apparatus, wherein the image writing apparatus comprises plural scanning optical systems, each scanning optical system for forming individual ones of plural images on respective ones of plural image carriers by scanning the image carriers with respective ones of plural beams, wherein each scanning optical system includes a lens having optical characteristics identical to those of corresponding lenses in all others of the plural scanning optical systems, wherein said method comprises:

forming the plurality of lenses having identical optical characteristics by use of a plurality of cavities which are divided into plural groups of cavities;

forming individual ones of the plural scanning optical systems by using the formed lenses;

wherein the plurality of lenses having identical optical characteristics have relative differences in a value of the optical characteristics which are not within an allowable range, wherein the plurality of cavities are divided into the plural groups of cavities according to variations in the optical characteristics of the plurality of lenses formed by use of the plurality of cavities so that the relative differences in the value of the optical characteristics are within the allowable range, wherein lenses used in one image writing apparatus are formed from cavities of one of the plural groups of cavities and all of the plural groups of cavities have at least one almighty cavity with respect to the plurality of cavities so that the relative differences of the lenses in the value of the optical characteristics are within the allowable range, and wherein the allowable range of the relative differences of the lenses in the value of the optical characteristics is that a relative difference of an irradiating position height is 100 μm or less in an entire scanning region on the image carriers, or the allowable range of the relative differences of the lenses in the value of the optical characteristics is that a relative difference in dot positional shift in a main scanning direction is 100 μm or less in the entire scanning region on the image carriers.

* * * * *